US008579577B2

(12) United States Patent
Sinzaki

(10) Patent No.: US 8,579,577 B2
(45) Date of Patent: Nov. 12, 2013

(54) FAN WITH SOUND-MUFFLING BOX

(75) Inventor: Kouji Sinzaki, Aichi (JP)

(73) Assignee: Panasonic Corporation, Osaka (JP)

( * ) Notice: Subject to any disclaimer, the term of this patent is extended or adjusted under 35 U.S.C. 154(b) by 1148 days.

(21) Appl. No.: 12/523,873

(22) PCT Filed: Jan. 29, 2008

(86) PCT No.: PCT/JP2008/000102

§ 371 (c)(1),
(2), (4) Date: Jul. 21, 2009

(87) PCT Pub. No.: WO2008/093496

PCT Pub. Date: Aug. 7, 2008

(65) Prior Publication Data

US 2010/0074728 A1 Mar. 25, 2010

(30) Foreign Application Priority Data

Jan. 30, 2007 (JP) ..... 2007-018910
Mar. 14, 2007 (JP) ..... 2007-064771

(51) Int. Cl.
*F04D 29/66* (2006.01)

(52) U.S. Cl.
USPC ..... 415/119; 415/121.3; 415/184; 415/196; 415/208.1; 181/224; 454/206

(58) Field of Classification Search
USPC ..... 415/119, 184, 201, 203, 204, 206, 415/213.1, 196, 200, 208.1, 98, 102; 181/224, 225, 226, 258; 454/206, 262, 454/906
See application file for complete search history.

(56) References Cited

U.S. PATENT DOCUMENTS 4,508,486 A * 4/1985 Tinker ..... 415/119

FOREIGN PATENT DOCUMENTS

| | | | |
|---|---|---|---|
| JP | 57-109300 | U | 7/1982 |
| JP | 61-119048 | U | 7/1986 |
| JP | 2001-050199 | A | 2/2001 |
| JP | 2002-156139 | | 5/2002 |
| JP | 2002-156139 | A | 5/2002 |
| JP | 2007-032434 | | 2/2007 |

OTHER PUBLICATIONS

International Search Report of PCT Application No. PCT/JP2008/000102 dated Mar. 11, 2008.

* cited by examiner

*Primary Examiner* — Edward Look
*Assistant Examiner* — Aaron R Eastman
(74) *Attorney, Agent, or Firm* — Panasonic Patent Center

(57) ABSTRACT

A fan with a sound deadening box has in its body a double inlet centrifugal fan and an inlet-port sound absorber formed between the fan and a body air inlet. The fan further includes a casing-inlet-port-side air passage and triangular prism shaped first inlet-port-sound-absorber air passage. With this structure, the fan has a low pressure loss, a low input, high static pressure, and a low level of airflow collision noise.

29 Claims, 24 Drawing Sheets

Prior Art

Prior Art

Prior Art

FAN WITH SOUND-MUFFLING BOX

CROSS-REFERENCE TO RELATED APPLICATIONS

This application is a U.S. national phase application of PCT international application PCT/JP2008/000102, filed Jan. 29, 2008.

TECHNICAL FIELD

The present invention relates to a fan with a sound deadening box having a sound deadening member, the fan being installed in an air passage of a ventilation fan or the like.

BACKGROUND ART

Some conventional fans with sound deadening boxes include a flow-dividing sound deadening member in the vicinity of their body air inlets. The flow-dividing sound deadening member means a sound deadening member having a corner with a recess on the opposite-motor-side casing-inlet-port-side air passage thereof. One such conventional fan is disclosed in Patent Document 1.

Other conventional fans with sound deadening boxes include an air guide plate in the vicinity of their casing inlet ports. One such conventional fan is disclosed in Patent Document 2.

One of the first-mentioned conventional fans with sound deadening boxes including a flow-dividing sound deadening member in the vicinity of their body air inlets will be described as follows with reference to drawings. FIGS. 26 and 27 show conventional fan 100 with a sound deadening box (hereinafter, fan 100) including the flow-dividing sound deadening member.

As shown in FIGS. 26 and 27, fan 100 is installed on the floor of attic 101. Fan 100 includes body 106, which is provided on its opposite sides with body air inlet 102 (hereinafter, inlet 102) and body air outlet 104 (hereinafter, outlet 104). Inlet 102 is disposed on the suction side of body 106 and connected to suction-side duct 103 (hereinafter, duct 103) so as to draw the air indoors 115 into body 106. Outlet 104 is disposed on the exhaust side of body 106 and connected to exhaust-side duct 105 (hereinafter, duct 105) so as to exhaust the air indoors 115 to outdoors 121 via body 106. Body 106 includes double inlet centrifugal fan 111 (hereinafter, fan 111).

Fan 111 includes fan casing 107 (hereinafter, casing 107), motor 108, opposite-motor-side casing inlet port 109 (hereinafter, port 109), and motor-side casing inlet port 110 (hereinafter, port 110). Fan 111 further includes double inlet impeller 120 (hereinafter, impeller 120) and disk-shaped main plate 119. Impeller 120 is disposed on both sides of main plate 119 and has blade inner diameter 118 substantially the same as the diameter of ports 109 and 110. Fan 100 further includes opposite-motor-side casing-inlet-port-side air passage 113 (hereinafter, air passage 113) on the inlet port 109 side and motor-side casing-inlet-port-side air passage 116 (hereinafter, air passage 116) on the inlet port 110 side. Air passage 113 is formed between inlet 102 and port 109, and air passage 116 is formed between inlet 102 and port 110. Fan 100 further includes flow-dividing sound deadening member 112, which is fixed on the side of casing 107 that faces inlet 102, that is, on the rear surface of casing 107. Flow-dividing sound deadening member 112 includes recess 114 on the air passage 113 side thereof so as to have a corner. Port 110 is disposed beyond motor outer diameter 117.

When fan 111 is driven, the air indoors 115 is drawn into body 106 through duct 103 and divided by flow-dividing sound deadening member 112. Of the divided air, an airflow passed through air passage 116 is drawn through port 110, and an airflow passed through air passage 113 is drawn through port 109. The airflows drawn through ports 109 and 110 pass through fan 111 and are exhausted to outdoors 121 through outlet 104 and duct 105.

In conventional fan 100, the presence of motor 108 causes air passage 116 to have a small width, and hence, a high wind speed. In order to prevent noise due to the high wind speed, the airflow in air passage 116 is controlled to be small. More specifically, flow-dividing sound deadening member 112 has recess 114 in the vicinity of the entrance air passage 113, making air passage 113 have a large passage section, and hence, a large airflow. Thus having a large airflow in air passage 113 divides the airflow into air passages 113 and 116 with a difference in air flow. Air passage 113 has a large passage section in the vicinity of inlet 102, but a small passage section in the vicinity of port 109, thereby causing a pressure loss in the vicinity of port 109 of air passage 113. As a result, conventional fan 100 has a high input, low static pressure, and a high level of airflow collision noise due to a narrow passage.

On the other hand, one of the second-mentioned fans with sound deadening boxes having an air guide plate in the vicinity of their casing inlet port will be described as follows with reference to FIGS. 28 to 30. FIGS. 28 to 30 show conventional fan 100*a* with a sound deadening box (hereinafter, fan 100*a*) having an air guide plate.

As shown in FIGS. 28 to 30, fan 100*a* is installed on the floor of attic 101. Fan 100*a* includes body 106, which is provided on its opposite sides with body air inlet 102 and body air outlet 104. Inlet 102 is disposed on the suction side of body 106 and connected to suction-side duct 103 so as to draw the air of indoors 115 into body 106. Outlet 104 is disposed on the exhaust side of body 106 and connected to exhaust-side duct 105 so as to exhaust the air indoors 115 to outdoors 121 via body 106. Body 106 includes single inlet centrifugal fan 111*a* (hereinafter, fan 111*a*).

Fan 111*a* includes fan casing 107, single inlet impeller 120*a* (hereinafter, impeller 120*a*), motor 108, and casing inlet port 109*a* (hereinafter, port 109*a*). Casing 107 includes scroll 137, casing side plate 138, discharge port 139, and tongue 140. Impeller 120*a* is disposed on disk-shaped main plate 119 and rotated in rotational direction 123 by motor 108. Fan 100*a* further includes air guide plate 148, which is inclined from intersection 146 of the center line of impeller 120*a* and body 106 toward outer periphery 147 of port 109*a* on the discharge port side.

Fan 100*a* further includes casing-inlet-port-side air passage 113*a* (hereinafter, air passage 113*a*), which is formed between inlet 102 and port 109*a* on the port 109*a* side. Air passage 113*a* has a width D smaller than the inner diameter of port 109*a*, and a center height at center height position 113*b*. Impeller 120*a* has a center height at center height position 120*b*.

When fan 111*a* is driven, the air indoors 115 is drawn into body 106 through duct 103, and passes through air passage 113*a*. An airflow passed through air passage 113*a* is vertically divided along the outer periphery of scroll 137 into discharge-port-side airflow 121 (hereinafter, airflow 121) and tongue-side airflow 122 (hereinafter, airflow 122). The divided airflows are deflected by air guide plate 148 and drawn through port 109*a*. The airflows drawn through port 109*a* pass through fan 111*a* and are exhausted to outdoors 121 through duct 105.

In conventional fan 100*a*, air guide plate 148 is inclined with respect to port 109*a* in order to guide the airflow from air passage 113*a* through port 109*a*. Scroll 137, however, is generally logarithmic-spirally increased, causing center height position 120*b* of impeller 120*a* to be slightly lower than center height position 113*b* of air passage 113*a*. As a result, airflow 121 is larger than airflow 122. Airflow 121 swirls in rotational direction 123 of impeller 120*a* along the bottom of air guide plate 148, thereby being guided through port 109*a*. Airflow 122, on the other hand, swirls in rotational direction 123 of impeller 120*a* by the force of airflow 121 and becomes a pre-swirling flow to be guided through port 109*a*.

Such a pre-swirling flow in the rotational direction of impeller 120*a* at port 109*a* reduces the relative speed of the airflow passing through rotating impeller 120*a*, thereby decreasing air flow. The pre-swirling flow also collides with the airflow from air passage 113*a*, thereby causing turbulent flow in the vicinity of port 109*a*. As a result, fan 100*a* has low air flow due to pressure loss, a high input, and a high level of turbulent flow noise.

Patent Document 1: Japanese Patent Unexamined Publication No. 2002-156139

Patent Document 2: Japanese Utility Model Unexamined Publication No. S61-119048

SUMMARY OF THE INVENTION

The present invention provides a fan with a sound deadening box, the fan having a unique shape and arrangement of the sound deadening member, thereby having a low pressure loss in a sound-deadening air passage, a low input, high static pressure, and a low level of airflow collision noise.

Furthermore, the present invention provides a fan with a sound deadening box, the fan having a low occurrence of turbulent flow, thereby having a low pressure loss, high air flow, a low input, and a low level of turbulent flow noise.

A fan with a sound deadening box of the present invention includes a box-shaped body, a double inlet centrifugal fan, an inlet-port sound absorber, casing-inlet-port-side air passages, and a first inlet-port-sound-absorber air passage. The body includes a body air inlet and a body air outlet facing each other. The double inlet centrifugal fan includes a discharge port, a spiral scroll, casing inlet ports, a fan casing having casing side plates on both sides thereof, the casing side plates having the casing inlet ports, a motor disposed on a side of one of the casing inlet ports, and a double inlet impeller driven by the motor. The inlet-port sound absorber is disposed between the body air inlet and the double inlet centrifugal fan. The casing-inlet-port-side air passages are formed in spaces between the body air inlet and the casing inlet ports, the spaces being sandwiched between the double inlet centrifugal fan and the inner surfaces of the body that face the casing inlet ports. The first inlet-port-sound-absorber air passage is formed to have a triangular prism shape by cutting a corner of a ridge line of the inlet-port sound absorber. With this structure, the fan with the sound deadening box has a low pressure loss and a low level of airflow collision noise, while ensuring the air flow.

Moreover, a fan with a sound deadening box of the present invention includes a box-shaped body, a double inlet centrifugal fan, an inlet-port sound absorber, casing-inlet-port-side air passages, and a second inlet-port-sound-absorber air passage. The body includes a body air inlet and a body air outlet facing each other. The double inlet centrifugal fan includes a discharge port, a spiral scroll, casing inlet ports, a fan casing having casing side plates on both sides thereof, the casing side plates having the casing inlet ports, a motor disposed on a side of one of the casing inlet ports, and a double inlet impeller driven by the motor. The inlet-port sound absorber is disposed between the body air inlet and the double inlet centrifugal fan. The casing-inlet-port-side air passages are formed in spaces between the body air inlet and the casing inlet ports, the spaces being sandwiched between the double inlet centrifugal fan and the inner surfaces of the body that face the casing inlet ports. The second inlet-port-sound-absorber air passage is formed to have a rectangular prism shape in a space between the surface of the inlet-port sound absorber that does not face the casing-inlet-port-side air passages and the inner surface of the body that faces the inlet-port sound absorber. With this structure, the fan with the sound deadening box has a low pressure loss and a low level of airflow collision noise, while ensuring the air flow.

Furthermore, a fan with a sound deadening box of the present invention includes a box-shaped body, a double inlet centrifugal fan, casing-inlet-port-side air passages, a body sound absorber, and a rectifying member. The body includes a body air inlet and a body air outlet facing each other. The double inlet centrifugal fan includes a discharge port, a spiral scroll, casing inlet ports, a fan casing having casing side plates on both side thereof, the casing side plates having the casing inlet ports, a motor disposed on a side of one of the casing inlet ports, and a double inlet impeller driven by the motor. The casing-inlet-port-side air passages are formed in spaces between the body air inlet and the casing inlet ports, the spaces being sandwiched between the double inlet centrifugal fan and the inner surfaces of the body that face the casing inlet ports. The body sound absorber is formed between the casing inlet port and the inner surface of the body. The rectifying member is formed on the body sound absorber and has a vertical rectification stage and a horizontal rectification stage. The rectifying member has a height smaller than the height inside the body, and is disposed to face the casing side plate in parallel therewith in the vicinity of the tongue of the casing side plate. Thus, the rectifying member narrows the casing-inlet-port-side air passage both toward the discharge port and from a body plane side on the tongue side of the double inlet centrifugal fan. The vertical rectification stage is located in front of the casing inlet port, and orthogonal to an airflow passing through the casing-inlet-port-side air passage. The horizontal rectification stage is located in parallel with the airflow passing through the casing-inlet-port-side air passage. With this structure, the fan with the sound deadening box has a low pressure loss due to a low turbulent flow in the vicinity of the casing inlet port, high air flow, a low input, and a low level of turbulent flow noise.

Furthermore, a fan with a sound deadening box of the present invention includes a box-shaped body, a double inlet centrifugal fan, casing-inlet-port-side air passages, a body sound absorber, and a guide member. The body includes a body air inlet and a body air inlet facing each other. The double inlet centrifugal fan includes a discharge port, a spiral scroll, casing inlet ports, a fan casing having casing side plates on both sides thereof, the casing side plates having the casing inlet ports, a motor disposed on a side of one of the casing inlet ports, and a double inlet impeller driven by the motor. The casing-inlet-port-side air passages are formed in spaces between the body air inlet and the casing inlet ports, the spaces being sandwiched between the double inlet centrifugal fan and the inner surfaces of the body that face the casing inlet ports. The body sound absorber is formed between the casing inlet port and the inner surface of the body. The guide member is formed on the body sound absorber and has vertical guide stage. The guide member has substantially the same height as the height inside the body and is disposed to face the casing side plate in parallel therewith. Thus, the guide member narrows the casing-inlet-port-side air passage toward the discharge port. The vertical guide stage is located in front of the casing inlet port, and orthogonal to an airflow passing through the casing-inlet-port-side air passage. With this structure, the fan with the sound deadening box has a low pressure loss due to a low turbulent flow in the vicinity of the casing inlet port, high air flow, a low input, and a low level of turbulent flow noise.

REFERENCE MARKS IN THE DRAWINGS

Figure 1:
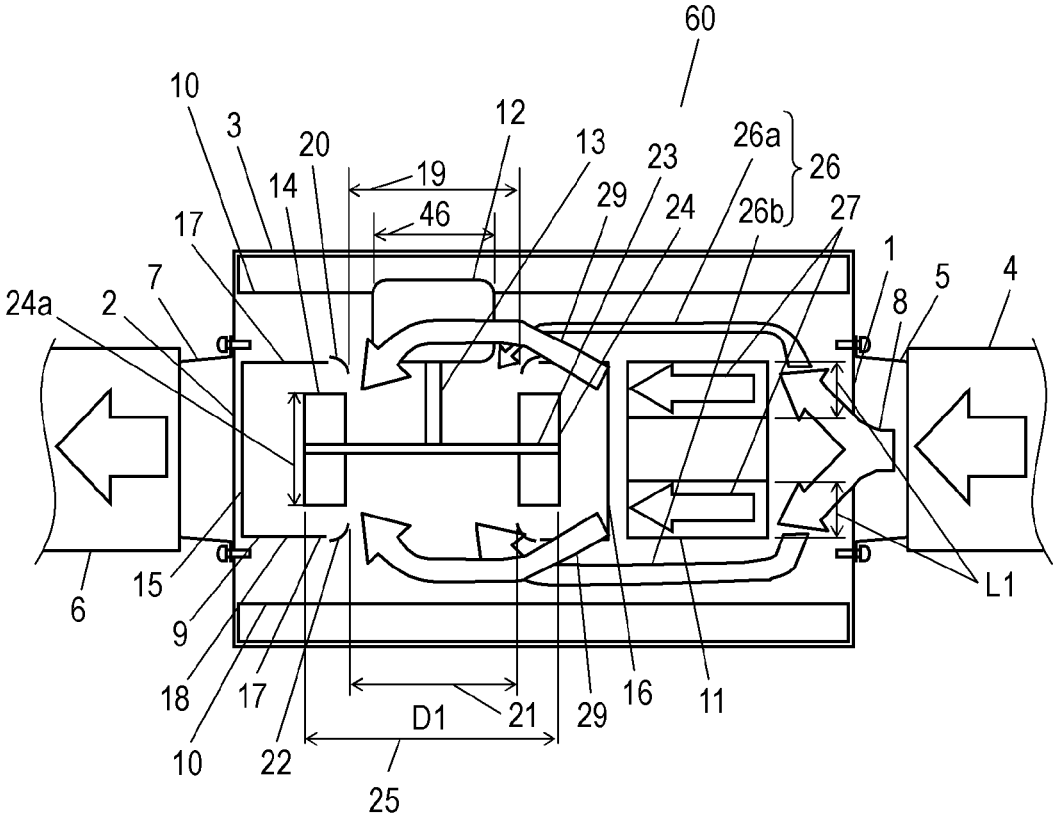
FIG. 1 is a plan view of a fan with a sound deadening box according to a first embodiment of the present invention.

1 body air inlet
2 body air outlet
3 body
4 suction-side duct
5 suction adapter
6 exhaust-side duct
7 exhaust adapter
8 air passage
9 double inlet centrifugal fan
10 body sound absorber
11 inlet-port sound absorber
12 motor
13 drive shaft
14 double inlet impeller
15 discharge port
16 scroll
17 casing side plate
18 fan casing
19 motor-side casing inlet port
20 motor-side orifice
21 opposite-motor-side casing inlet port
22 opposite-motor-side orifice
23 main plate
24 blade
24*a* blade width
25 diameter
26 casing-inlet-port-side air passage
26*a* motor-side casing-inlet-port-side air passage
26*b* opposite-motor-side casing-inlet-port-side air passage
27 first inlet-port-sound-absorber air passage
28, 39 body plane
29 directed-to-discharge-port airflow
35 discharge airflow
36 tongue
38 second inlet-port-sound-absorber air passage
40 directed-to-tongue airflow
41 suction airflow
43 scroll rear-side air passage
44 single inlet impeller
46 motor outer diameter
47 single inlet centrifugal fan

48 casing inlet port
51 rectifying member
51*a* vertical rectification stage
51*b* horizontal rectification stage
52 guide member
52*a* vertical guide stage
53 discharge-port-side end
54 directed-to-axis-of-rotation airflow
55 discharge-port-side airflow
55*a* directed-to-discharge-port suction airflow
56 tongue-side airflow
57 backflow
58 suction airflow
60, 60*a*, 60*b*, 60*c*, 60*d*, 60*e*, 60*f*, 60*g*, 60*h*, 60*j*, 60*k*, 60*m* fan with a sound deadening box

DETAILED DESCRIPTION OF PREFERRED EMBODIMENTS

Embodiments of the present invention will be described as follows with reference to drawings.

First Embodiment

Figure 2:
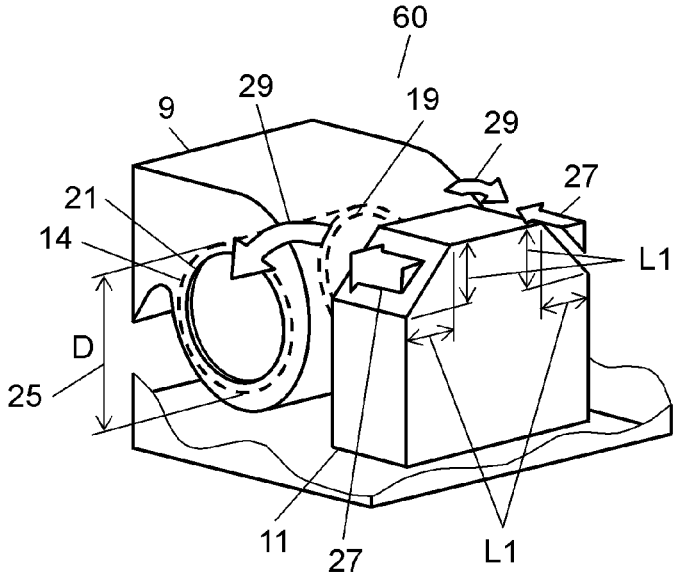
FIG. 2 is a perspective view of the fan of FIG. 1 in the vicinity of an inlet-port sound absorber.
Figure 3:
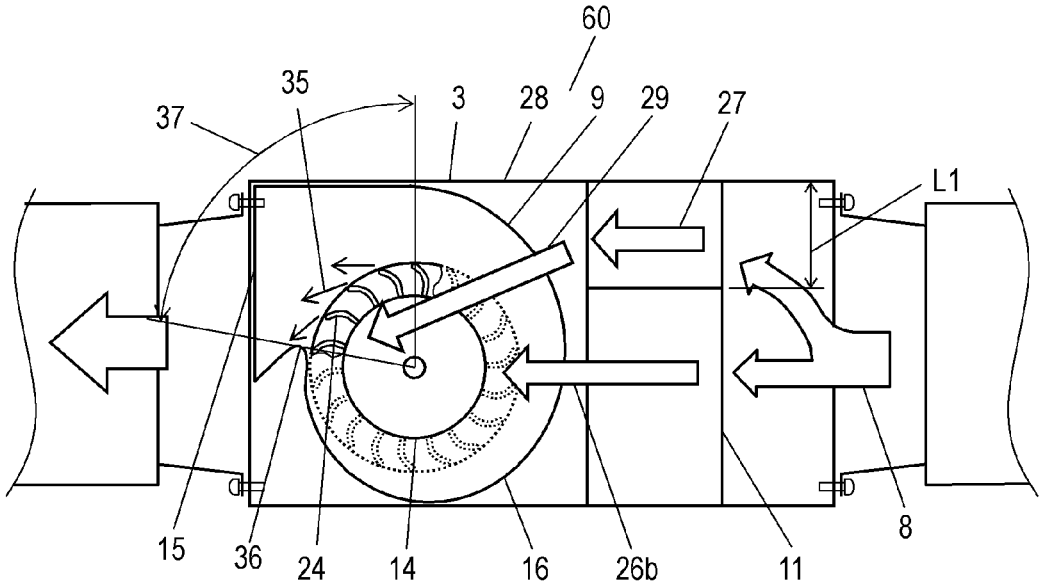
FIG. 3 is a side view of the fan of FIG. 1.
Figure 4:
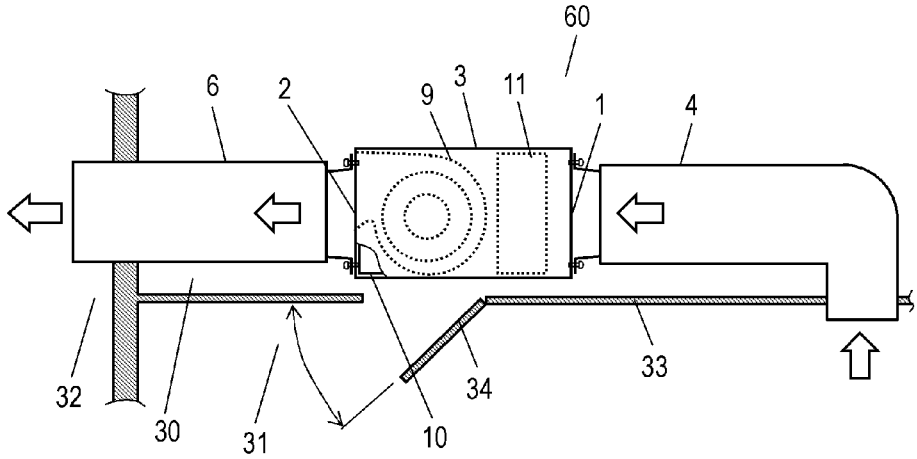
FIG. 4 is a side view where the fan of FIG. 1 is installed.
Figure 5:
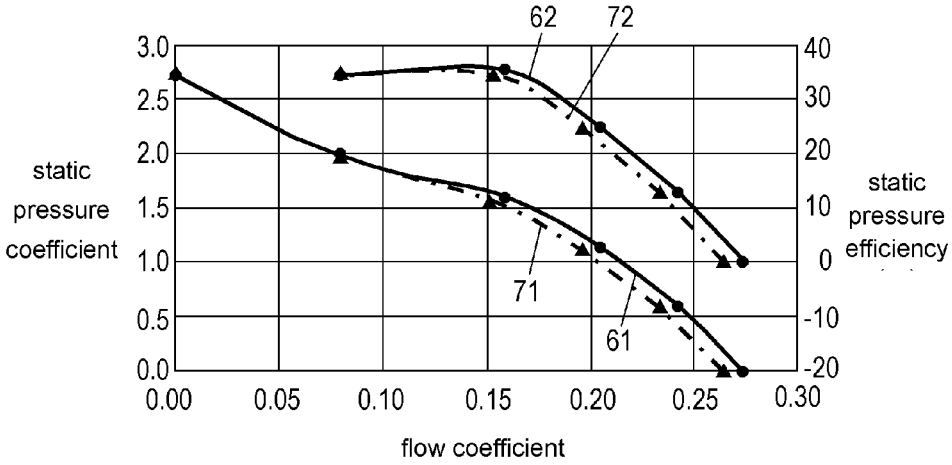
FIG. 5 is a non-dimensional characteristic diagram showing characteristics of the fan of FIG. 1.

A first embodiment of the present invention will be described as follows with reference to FIGS. 1 to 5. FIG. 1 is a plan view of fan 60 with a sound deadening box (hereinafter, fan 60) according to the first embodiment. FIG. 2 is a perspective view of fan 60 of FIG. 1 in the vicinity of inlet-port sound absorber 11 (hereinafter, sound absorber 11). FIG. 3 is a side view of fan 60 of FIG. 1. FIG. 4 is a side view where fan 60 of FIG. 1 is installed. FIG. 5 is a non-dimensional characteristic diagram showing characteristics of fan 60 of FIG. 1.

As shown in FIGS. 1 to 4, fan 60 includes box-shaped body 3. Body 3 is provided on its opposite sides with body air inlet 1 (hereinafter, inlet 1) and body air outlet 2 (hereinafter, outlet 2). Inlet 1 is disposed on the suction side of body 3 and connected to suction-side duct 4 (hereinafter, duct 4) so as to draw the air indoors 31 into body 3. Outlet 2 is disposed on the exhaust side of body 3 and connected to exhaust-side duct 6 (hereinafter, duct 6) so as to exhaust the air indoors 31 to outdoors 32 via body 3. Body 3 includes suction adapter 5 for connecting inlet 1 to duct 4, and exhaust adapter 7 for connecting outlet 2 to duct 6. Body 3 includes air passage 8, which is formed between inlet 1 and outlet 2. Fan 60 further includes double inlet centrifugal fan 9 (hereinafter, fan 9), body sound absorbers 10 (hereinafter, sound absorbers 10), and inlet-port sound absorber 11 (hereinafter, sound absorber 11) in air passage 8. Sound absorbers 10 and 11 are made of a porous sound absorbing material with a high proportion of air. Examples of the porous sound absorbing material include foamed resins such as glass wool, rock wool, and foamed urethane resin, and plasterboard.

Fan 9 includes motor 12, double inlet impeller 14 (hereinafter, impeller 14), discharge port 15, spiral scroll 16, and fan casing 18 (hereinafter, casing 18). Impeller 14 is fixed to motor 12 by drive shaft 13. Discharge port 15 faces outlet 2. Casing 18 includes opposite side surfaces formed of casing side plates 17 (hereinafter, side plates 17). Side plates 17 include motor-side orifice 20 open to motor-side casing inlet port 19 (hereinafter, port 19) and opposite-motor-side orifice 22 open to opposite-motor-side casing inlet port 21 (hereinafter, port 21). Impeller 14 includes disk-shaped main plate 23 and a plurality of blades 24. Main plate 23 is connected to drive shaft 13, and blades 24 are joined to both sides of main plate 23. Blades 24 have an outer diameter equal to a dimension D1 of diameter 25 of impeller 14. Port 19 has an inner diameter which is larger than motor outer diameter 46 and is beyond motor outer diameter 46. Blades 24 have blade width 24*a* equal to a width of impeller 14.

Fan 60 further includes motor-side casing-inlet-port-side air passage 26*a* (hereinafter, air passage 26*a*) and opposite-motor-side casing-inlet-port-side air passage 26*b* (hereinafter, air passage 26*b*). Air passage 26*a* is formed in a space which exists between inlet 1 and port 19 and is sandwiched between fan 9 and an inner surface of body 3 that faces port 19. Air passage 26*b* is formed in a space which exists between inlet 1 and port 21 and is sandwiched between fan 9 and an inner surface of body 3 that faces port 21. Air passages 26*a* and 26*b* form casing-inlet-port-side air passages 26 (hereinafter, air passages 26). Fan 60 further includes first inlet-port-sound-absorber air passages 27 (hereinafter, air passages 27). Air passages 27 are formed by cutting a corner of a ridge line of sound absorber 11 that are in contact with the airflow passing through air passages 26 in such a manner as to have a cut dimension L1. Thus, air passages 27 have a substantially triangular prism shape with a side length of L1.

Air passages 27 are formed on an inner surface side of body 3 that faces body plane 28 of body 3 on the discharge port 15 side of fan 9. As a result, the airflows passed through air passages 27 enter through ports 19 and 21 as directed-to-discharge-port airflows 29 (hereinafter, airflows 29). Airflows 29 are inclined toward the suction center of impeller 14 in the vicinity of fan 9, and then discharged through discharge port 15. After passing through air passages 27, airflows 29 join discharge airflow 35 (hereinafter, airflow 35) flowing in the direction of the blade outlet angle of impeller 14 in such a manner as to be substantially in parallel therewith, thereby having a low blowing load.

As shown in FIG. 4, body 3 is installed on the floor of attic 30 in such a manner as to be connected to duct 4 at inlet 1 and to duct 6 at outlet 2. When fan 9 is driven, the air indoors 31 is drawn into fan 60 through duct 4, and then exhausted from fan 9 to outdoors 32 through duct 6. Attic 30 and indoors 31 are separated by ceiling material 33, which has ceiling access door 34 below body 3.

Thus, fan 60 of the present invention including air passages 26 and 27 has a higher air flow than a fan with a sound deadening box having air passages 26 only. Fan 60 also has a large air passage section between inlet 1 and ports 19, 21 due to the presence of air passage 27, thereby having a low airflow collision loss.

After passing through air passages 27, airflows 29 join airflow 35 in such a manner as to be substantially in parallel therewith, thereby having a low blowing load of airflow. More specifically, centrifugal fans generally have a low blowing efficiency in discharge-port non-boost region 37 (hereinafter, region 37), which exists between the end of the logarithmic increase of scroll 16 and tongue 36. However, airflows 29 smoothly pass through between blades 24 and become airflow 35 flowing in the direction of the outlet angle of blades 24, thereby having a low blowing load.

Thus, fan 60 of the first embodiment has a low pressure loss in air passages 26 and 27 and a low input, while ensuring the airflow. Fan 60 also has a low level of airflow collision noise.

As described above, the corners of the ridge lines of sound absorber 11 are cut in such a manner as to have the cut dimension L1, making air passages 27 have a substantially triangular prism shape. Alternatively, the same action and effect can be obtained by having R-shaped curved surfaces or ridge lines of sound absorber 11 that face substantially triangular prism shaped air passages 27.

It is possible to reduce impeller 14 in size according to the reduction in the pressure loss in air passages 26 and 27, thereby reducing fan 9 in size and body 3 in thickness. As a result, attic 30 can have a small vertical space, securing a high-ceiling space indoors 31. In addition, fan 60 can be easily removed for maintenance through small ceiling access door 34. Thus, fan 60 requires little maintenance strain.

FIG. 5 is a characteristic diagram comparing operating characteristics between a conventional fan with a sound deadening box having a rectangular parallelepiped inlet-port sound absorber and fan 60 of the present invention. In the diagram, solid line 61 represents a relation between flow coefficient and static pressure coefficient of fan 60 according to the first embodiment, and solid line 62 represents a relation between flow coefficient and static pressure efficiency of fan 60. Similarly, chain line 71 represents a relation between flow coefficient and static pressure coefficient of the conventional fan, and chain line 72 represents a relation between flow coefficient and static pressure efficiency of the conventional fan. Fan 60 shown in FIG. 5 includes sound absorber 11 having a rectangular parallelepiped shape in which two sides are C-cut by setting L1 to 70 mm. In both double inlet centrifugal fans shown in FIG. 5, the double inlet impellers have a diameter D1 of 176 mm and a fan casing height of 329 mm, and the motor has four poles and an outer diameter of 120 mm, respectively.

As shown in FIG. 5, fan 60 has a higher static pressure efficiency than the conventional fan when the flow coefficient is in the range of 0.13 to 0.26. One reason for this is that, as described above, the air passage section between inlet 1 and ports 19, 21 is large due to the presence of air passages 27, thereby having a low airflow collision loss. Another reason is that after passing through air passages 27, airflows 29 join airflow 35 flowing in the direction of the blade outlet angle of impeller 14 in such a manner as to be substantially in parallel therewith, thereby having a low blowing load.

Second Embodiment

Figure 6:
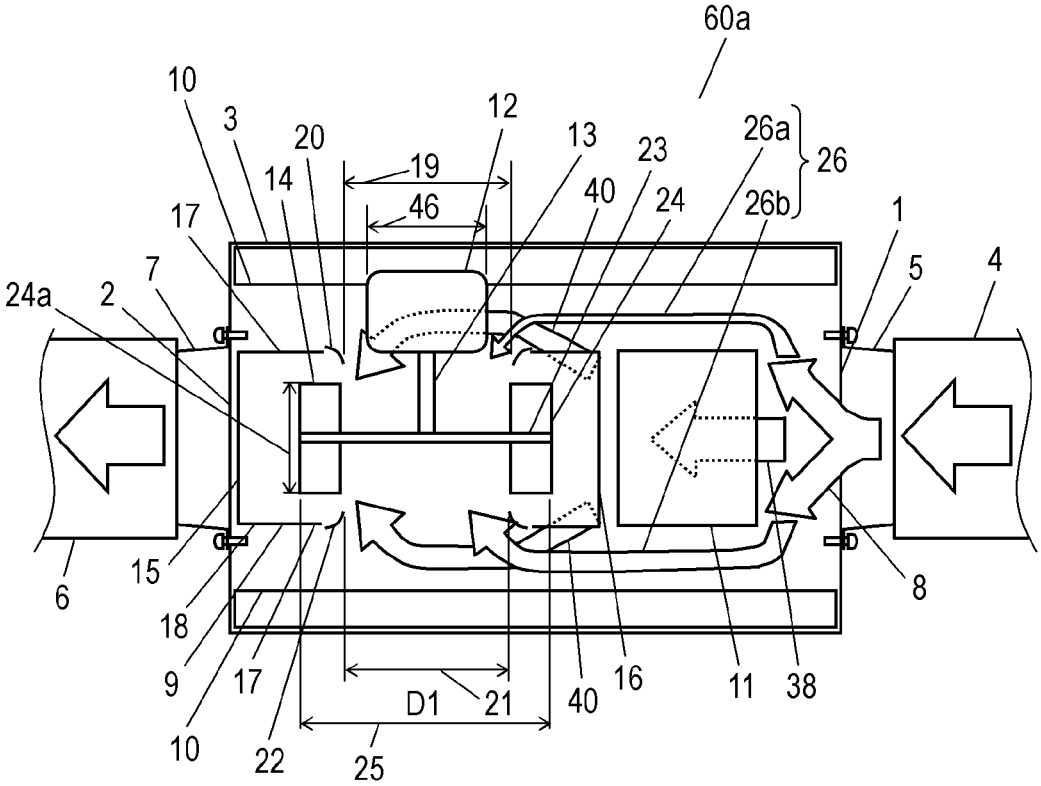
FIG. 6 is a plan view of a fan with a sound deadening box according to a second embodiment of the present invention.
Figure 7A:
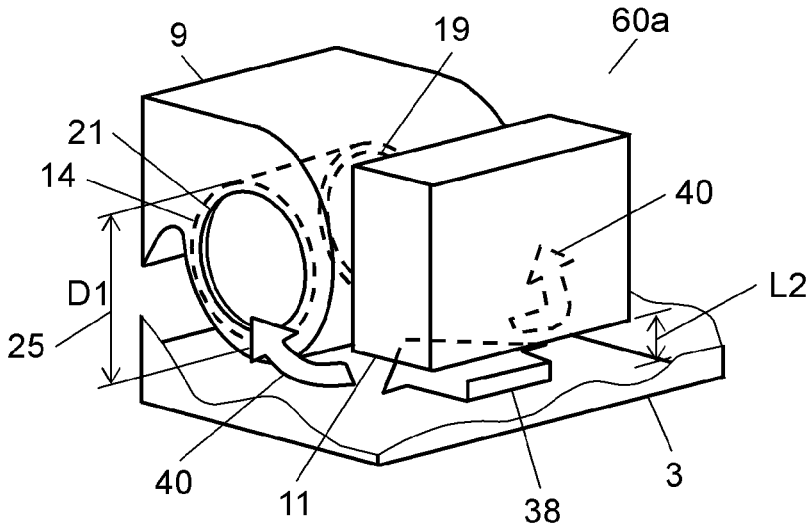
FIG. 7A is a perspective view of the fan of FIG. 6 in the vicinity of an inlet-port sound absorber.
Figure 7B:
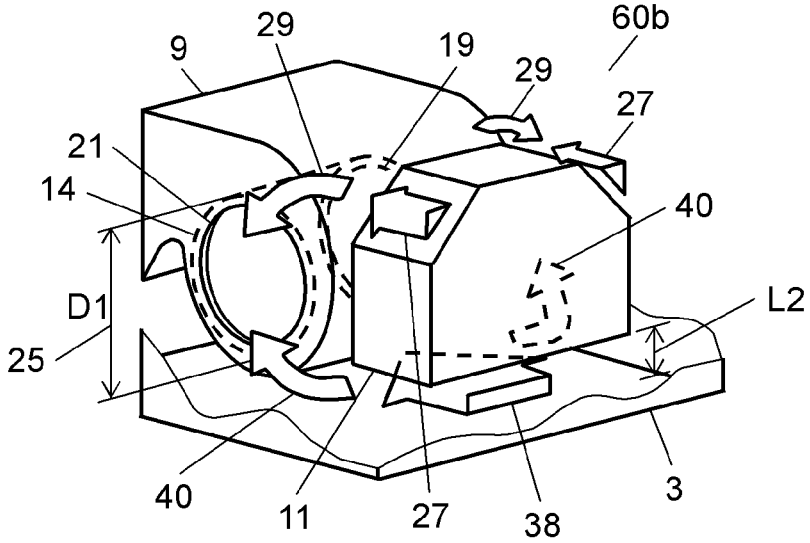
FIG. 7B is a perspective view of another example of the fan with the sound deadening box according to the second embodiment in the vicinity of an inlet-port sound absorber.
Figure 8:
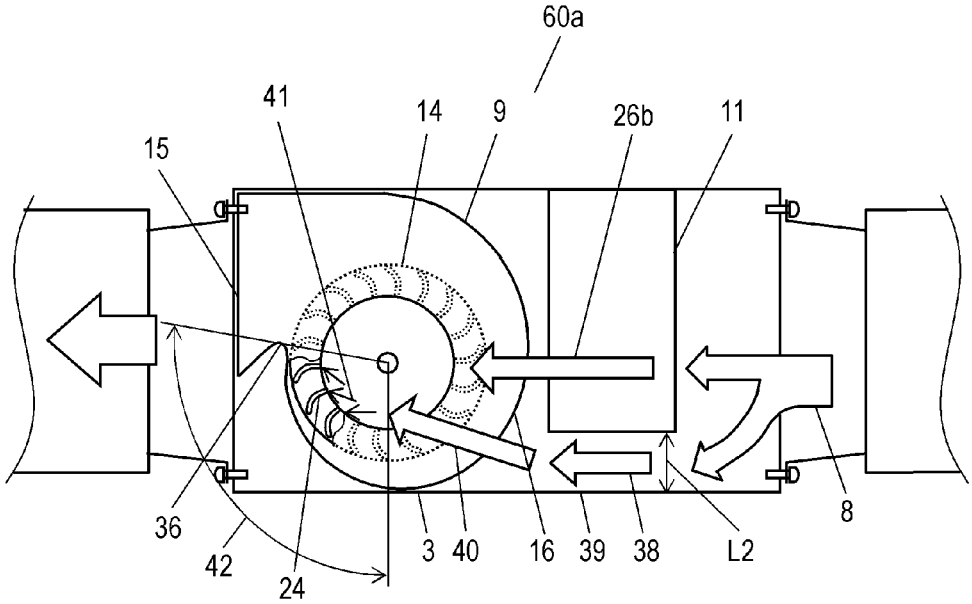
FIG. 8 is a side view of the fan of FIG. 6.
Figure 9:
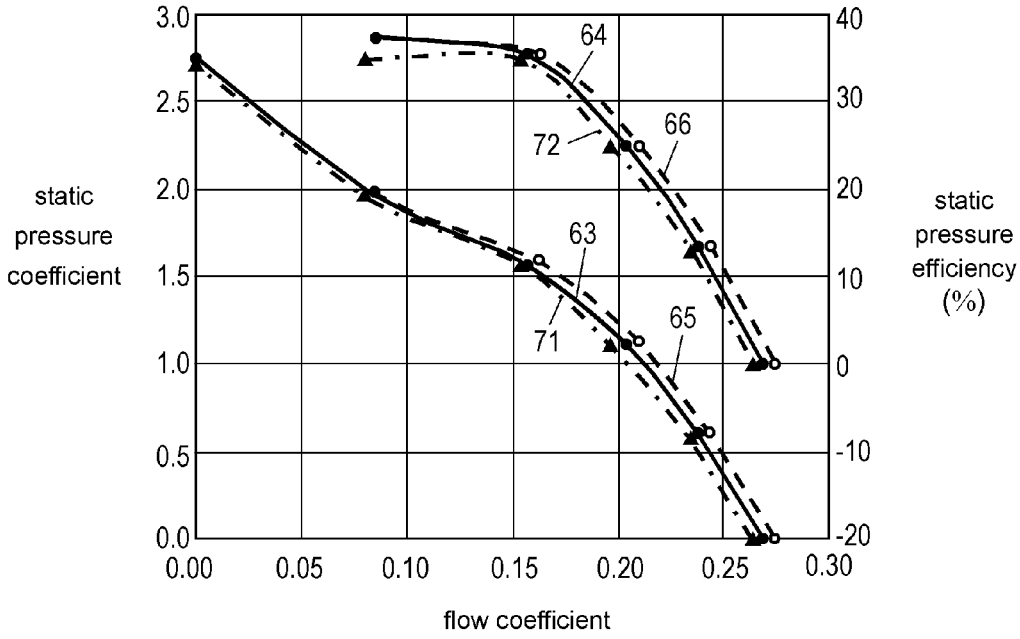
FIG. 9 is a non-dimensional characteristic diagram showing characteristics of the fans according to the second embodiment.

A second embodiment of the present invention will be described as follows with reference to drawings. The same components as in the first embodiment are denoted by the same reference numerals, and thus a detailed description thereof will be omitted. FIG. 6 is a plan view of fan 60*a* with a sound deadening box (hereinafter, fan 60*a*) according to the second embodiment. FIG. 7A is a perspective view of fan 60*a* of FIG. 6 in the vicinity of inlet-port sound absorber 11. FIG. 7B is a perspective view of another fan 60*b* with the sound deadening box (hereinafter, fan 60*b*) according to the second embodiment in the vicinity of inlet-port sound absorber 11. FIG. 8 is a side view of fan 60*a* of FIG. 6. FIG. 9 is a non-dimensional characteristic diagram showing characteristics of fans 60*a* and 60*b*.

Fan 60*a* of the second embodiment includes second inlet-port-sound-absorber air passage 38 (hereinafter, air passage 38) instead of first inlet-port-sound-absorber air passages 27 of fan 60 of the first embodiment. Air passage 38 is formed in the space with a height L2 between a surface of sound absorber 11 that does not face air passages 26 and the inner surface of body 3 that faces sound absorber 11. Air passage 38 has a substantially rectangular prism shape. The surface of sound absorber 11 that does not face air passages 26 indicates the surface different from the surface of sound absorber 11 that faces air passages 26.

Air passage 38 is formed on an inner surface side of body 3 that faces body plane 39 of body 3 on the tongue 36 side of fan 9. As a result, an airflow passed through air passage 38 enters through ports 19 and 21 as directed-to-tongue airflows 40 (hereinafter, airflows 40). Airflows 40 are inclined toward the suction center of impeller 14 in the vicinity of fan 9, and then discharged through discharge port 15. After passing through air passage 38, airflows 40 join suction airflow 41 (hereinafter, airflow 41) flowing in the direction of the blade inlet angle of impeller 14 in such a manner as to be substantially in parallel therewith, thereby having a high wind speed and a high pressure.

Thus, fan 60*a* of the present invention including air passages 26 and 38 has a higher air flow than the fan with the sound deadening box having air passages 26 only. Fan 60*a* has an air passage section between inlet 1 and ports 19, 21 due to the presence of air passage 38, thereby having a low airflow collision loss.

After passing through air passage 38, airflows 40 join airflow 41 in such a manner as to be substantially in parallel therewith, thereby having a high wind speed and a high pressure in the opening of blades 24. More specifically, centrifugal fans generally have a low blowing efficiency in tongue low boost region 42 (hereinafter, region 42), which exists at the start of the logarithmic increase of scroll 16 in the vicinity of tongue 36. However, airflows 40 face the inlet angle of blades 24 and become airflow 41 flowing in the direction of the blade inlet angle, thereby having a high wind speed to facilitate pressure transduction.

Thus, fan 60*a* of the second embodiment has a low pressure loss in air passages 26 and 38 and high static pressure, while ensuring the air flow. Fan 60*a* also has a low level of airflow collision noise.

As described above, substantially rectangular prism shaped air passage 38 is formed in the space with the height L2 from the inner surface of body 3 that faces sound absorber 11. Alternatively, the same action and effect can be obtained by having R-shaped curved surfaces or ridge lines of sound absorber 11 that face substantially rectangular prism shaped air passage 38.

It is possible to reduce impeller 14 in size according to the reduction in the pressure loss in air passages 26 and 38, thereby reducing fan 9 in size and body 3 in thickness. As a result, attic 30 can have a small vertical space, securing a high-ceiling space indoors 31. In addition, fan 60*a* can be easily removed for maintenance through small ceiling access door 34. Thus, fan 60*a* requires little maintenance strain.

As shown in FIG. 7B, it is possible to form first inlet-port-sound-absorber air passages 27 of fan 60 of the first embodiment on the body plane 28 side of body 3 on the discharge port 15 side of fan 9, which is different from the side having air passage 38. With this structure, fan 60*b* has a lower pressure loss than fan 60*a* due to the presence of air passages 27, while ensuring the air flow.

FIG. 9 is a characteristic diagram comparing operating characteristics between the conventional fan with the sound deadening box having the rectangular parallelepiped inlet-port sound absorber and fan 60*a* of the present invention. In the diagram, solid line 63 represents a relation between flow coefficient and static pressure coefficient of fan 60*a* according to the second embodiment, and solid line 64 represents a relation between flow coefficient and static pressure efficiency of fan 60*a*. Similarly, dotted line 65 represents a relation between flow coefficient and static pressure coefficient of fan 60*b*, which is obtained by adding air passages 27 to fan 60*a* according to the second embodiment, and dotted line 66 represents a relation between flow coefficient and static pressure efficiency of fan 60*b*. Similarly, chain line 71 represents the relation between flow coefficient and static pressure coefficient of the conventional fan, and chain line 72 represents the relation between flow coefficient and static pressure efficiency of the conventional fan. In fan 60*a* shown in FIG. 9, the distance between the inner surface of body 3 and rectangular-parallelepiped-shaped sound absorber 11 corresponds to a height L2 of 20 mm. In both double inlet centrifugal fans shown in FIG. 9, the double inlet impellers have a diameter D1 of 176 mm and a fan casing height of 329 mm, and the motor has four poles and an outer diameter of 120 mm, respectively.

As shown in FIG. 9, fan 60*a* has a higher static pressure coefficient than the conventional fan when the flow coefficient is in the range of 0 to 0.26. One reason for this is that, as described above, the air passage section between inlet 1 and ports 19, 21 is large due to the presence of air passage 38, thereby having a low airflow collision loss. Another reason is that after passing through air passage 38, airflows 40 join airflow 41 flowing in the direction of the blade inlet angle of impeller 14 in such a manner as to be substantially in parallel therewith, thereby having a high wind speed and a high pressure in the opening of the blades. Fan 60*b* has a higher static pressure coefficient than fan 60*a* because of the presence of air passages 27.

Third Embodiment

Figure 10:
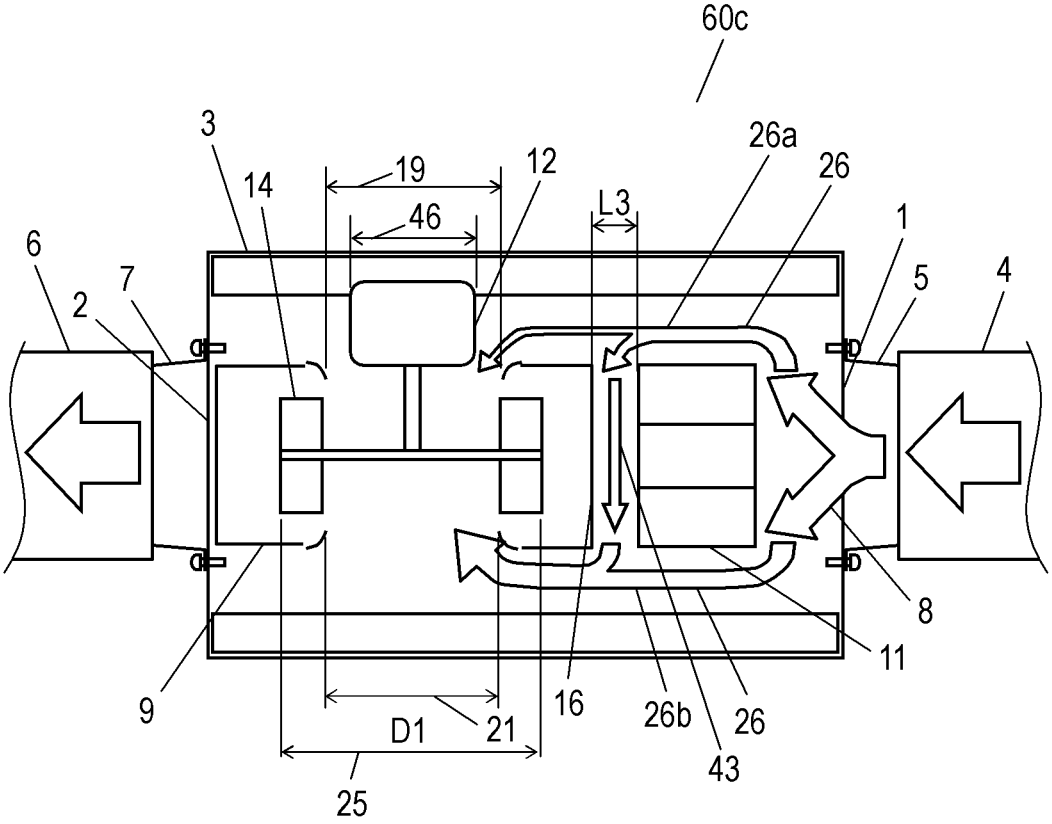
FIG. 10 is a plan view of a fan with a sound deadening box according to a third embodiment of the present invention.
Figure 11A:
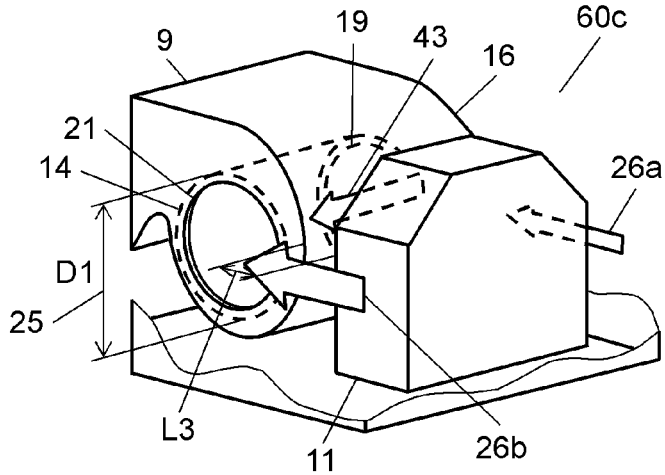
FIG. 11A is a perspective view of the fan of FIG. 10 in the vicinity of an inlet-port sound absorber.
Figure 11B:
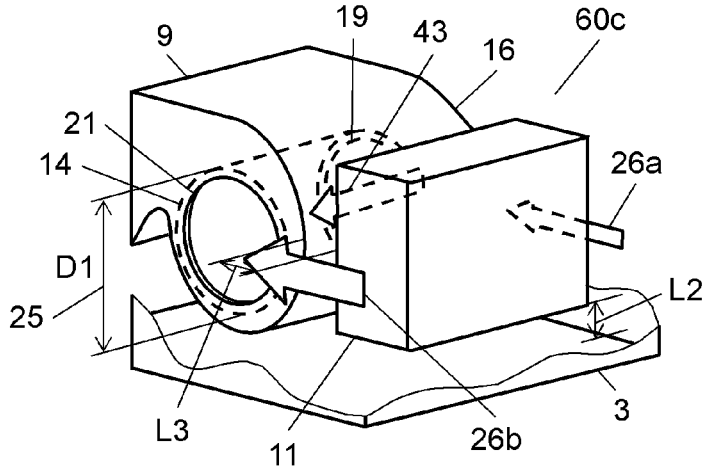
FIG. 11B is a perspective view of another example of the fan with the sound deadening box according to the third embodiment in the vicinity of an inlet-port sound absorber.

A third embodiment of the present invention will be described as follows with reference to drawing. The same components as in the first and second embodiments are denoted by the same reference numerals, and thus a detailed description thereof will be omitted. FIG. 10 is a plan view of fan 60*c* with a sound deadening box (hereinafter, fan 60*c*) according to the third embodiment. FIG. 11A is a perspective view of fan 60*c* of FIG. 10 in the vicinity of inlet-port sound absorber 11. FIG. 11B is a perspective view of another example of fan 60*c* with the sound deadening box according to the third embodiment in the vicinity of inlet-port sound absorber 11.

Fan 60*c* of the third embodiment includes scroll rear-side air passage 43 (hereinafter, air passage 43) in addition to the components of fan 60 of the first embodiment. More specifically, as shown in FIGS. 10 and 11A, sound absorber 11 and scroll 16 are spaced from each other at a dimension L3 where air passage 43 is formed. Air passage 43 communicates between air passage 26*a* and air passage 26*b*. The airflow passed through air passage 26*a* on the port 19 side is drawn through port 19. The airflow passed through air passage 26*b* on the port 21 side is drawn through port 21. The presence of motor 12 makes port 19 have a smaller effective opening area than port 21, and causes the airflow passed through air passage 26*a* to collide with motor 12. However, the presence of air passage 43 strikes a balance between the airflow passing through air passage 26*a* and the airflow passing through air passage 26*b*.

Thus, fan 60*c* of the third embodiment includes air passage 43 communicating between air passage 26*a* and air passage 26*b*. Part of the airflow in air passage 26*a*, which tends to have a larger pressure loss than in air passage 26*b*, joins air passage 26*b* through air passage 43, thereby reducing the pressure loss in air passage 26*a*. It is possible to reduce impeller 14 in size according to the reduction in the pressure loss in air passage 26*a*, thereby reducing fan 9 in size and body 3 in size and thickness. As a result, attic 30 can have a small vertical space, securing a high-ceilinged space indoors 31. In addition, fan 60*c* can be easily removed for maintenance through small ceiling access door 34. Thus, fan 60*c* requires little maintenance strain.

Even when sound absorber 11 divides airflow substantially equally in the vicinity of inlet 1, part of the airflow in air passage 26*a* joins the air passage 26*b* through air passage 43 according to the pressure loss in air passage 26*a*, thereby increasing the airflow in air passage 26*b*. This eliminates the need to increase the air passage section of air passage 26*b* or to use sound absorber 11 having a complex shape with a recess or the like in order to provide a difference in air flow. As a result, air passages 26 have a minimum size in the vicinity of inlet 1. Furthermore, it is possible to reduce impeller 14 in size according to the reduction in the pressure loss in air passage 26*a*, thereby reducing fan 9 in size and body 3 in size and thickness.

As described above, fan 60*c* of the third embodiment has a compact size with a low pressure loss in air passage 26*a* while ensuring the air flow. Fan 60*c* also has a low level of airflow collision noise.

Figure 11C:
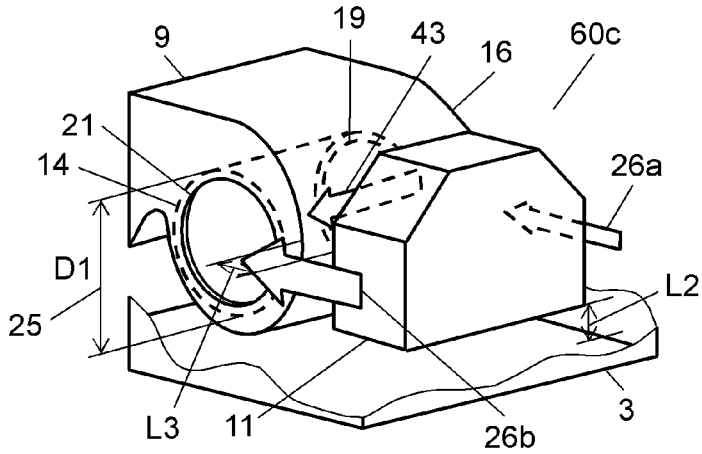
FIG. 11C is a perspective view of further another example of the fan with the sound deadening box according to the third embodiment in the vicinity of an inlet-port sound absorber.

Air passage 43 may be formed in the space with the dimension L3 between scroll 16 and sound absorber 11 having air passage 38 as shown in FIG. 11B (FIG. 7A), or between scroll 16 and sound absorber 11 having air passages 27 and 38 as shown in FIG. 11C (FIG. 7B). Both fans 60*c* shown in FIGS. 11B and 11C have the similar action and effect as fan 60*c* of FIG. 11A.

Fourth Embodiment

Figure 12:
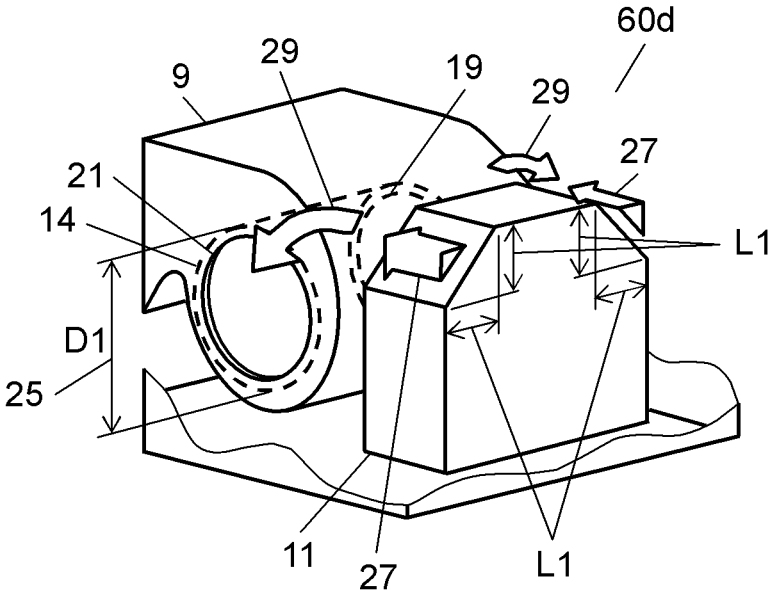
FIG. 12 is a perspective view of a fan with a sound deadening box according to a fourth embodiment of the present invention in the vicinity of an inlet-port sound absorber.

A fourth embodiment of the present invention will be described as follows with reference to drawings. The same components as in the first to third embodiments are denoted by the same reference numerals, and thus a detailed description thereof will be omitted. FIG. 12 is a perspective view of fan 60*d* with a sound deadening box (hereinafter, fan 60*d*) according to the fourth embodiment in the vicinity of inlet-port sound absorber 11.

In fan 60*d* of the fourth embodiment, as shown in FIG. 12, the cut dimension L1 of the corners of the ridge lines of sound absorber 11 that form air passages 27 and the dimension D1 of diameter 25 of impeller 14 satisfy a relation of L1<D1.

With this structure, fan 60*d* has a large air passage section between inlet 1 and ports 19, 21 due to the presence of air passages 27, and hence, a low airflow collision loss. The cut dimension L1 of the corners of the ridge lines of the sound absorber 11 is small enough with respect to the dimension D1 of diameter 25 of impeller 14, allowing sound absorber 11 to have a large volume.

Thus, fan 60*d* of the fourth embodiment has a low pressure loss in air passages 26 and low noise, while ensuring the air flow.

Fifth Embodiment

Figure 13:
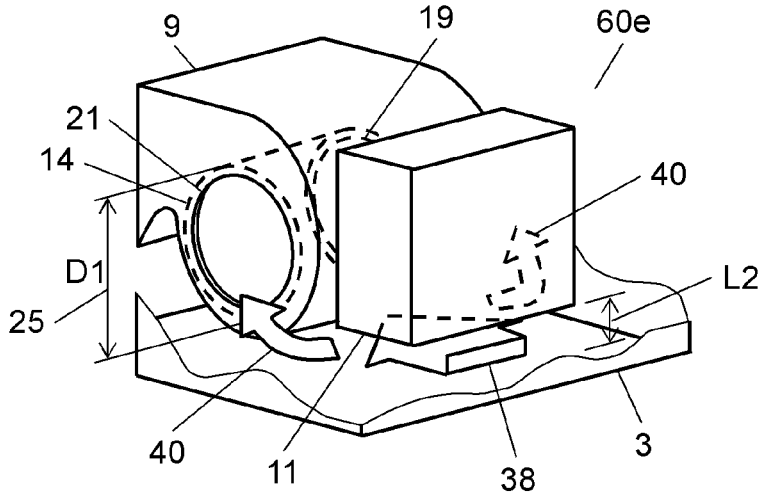
FIG. 13 is a perspective view of a fan with a sound deadening box according to a fifth embodiment of the present invention in the vicinity of an inlet-port sound absorber.

A fifth embodiment of the present invention will be described as follows with reference to drawings. The same components as in the first to fourth embodiments are denoted by the same reference numerals, and thus a detailed description thereof will be omitted. FIG. 13 is a perspective view of fan 60*e* with a sound deadening box (hereinafter, fan 60*e*) according to the fifth embodiment in the vicinity of inlet-port sound absorber 11.

As shown in FIG. 13, in fan 60*e* of the fifth embodiment, the dimension L2 where air passage 38 is formed between sound absorber 11 and the inner surface of body 3, and the dimension D1 of diameter 25 of impeller 14 satisfy a relation of L2<D1.

With this structure, fan 60*e* has a large air passage section between inlet 1 and ports 19, 21 due to the presence of air passage 38, and hence a low airflow collision loss. The dimension L2 between sound absorber 11 and the inner surface of body 3 is small enough with respect to the dimension D1 of diameter 25 of impeller 14, allowing sound absorber 11 to have a large volume.

Thus, fan 60*e* of the fifth embodiment has a low pressure loss in air passages 26 and low noise, while ensuring the air flow.

Sixth Embodiment

Figure 14:
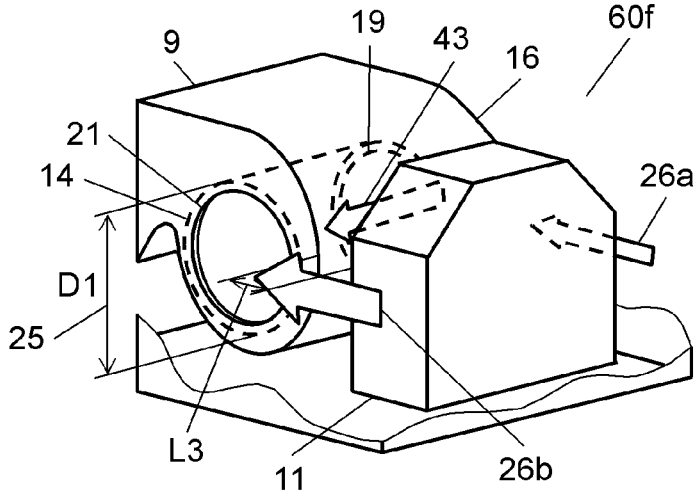
FIG. 14 is a perspective view of a fan with a sound deadening box according to a sixth embodiment of the present invention in the vicinity of an inlet-port sound absorber.

A sixth embodiment of the present invention will be described as follows with reference to drawings. The same components as in the first to fifth embodiments are denoted by the same reference numerals, and thus a detailed description thereof will be omitted. FIG. 14 is a perspective view of fan 60*f* with a sound deadening box (hereinafter, fan 60*f*) according to the sixth embodiment in the vicinity of inlet-port sound absorber 11.

In fan 60*f* of the sixth embodiment, as shown in FIG. 14, the dimension L3 where air passage 43 is formed between scroll 16 and sound absorber 11, and the dimension D1 of diameter 25 of impeller 14 satisfy a relation of L3<D1.

With this structure, part of the airflow in air passage 26*a* joins air passage 26*b* through air passage 43. The presence of air passage 43 strikes a balance between the airflow passing through air passage 26*a* and the airflow passing through air passage 26*b*, thereby reducing the pressure loss in air passage 26*a*. Furthermore, the dimension L3 between sound absorber 11 and scroll 16 is small enough with respect to the dimension D1 of diameter 25 of impeller 14, allowing sound absorber 11 to have a large volume.

Thus, fan 60*f* of the sixth embodiment has a low pressure loss in air passages 26 and low noise, while ensuring the air flow.

Fan 60*f* of FIG. 14 has air passages 27, but may alternatively have air passage 38 instead of air passages 27, or both air passages 27 and 38 so as to provide the similar action and effect.

Seventh Embodiment

Figure 15A:
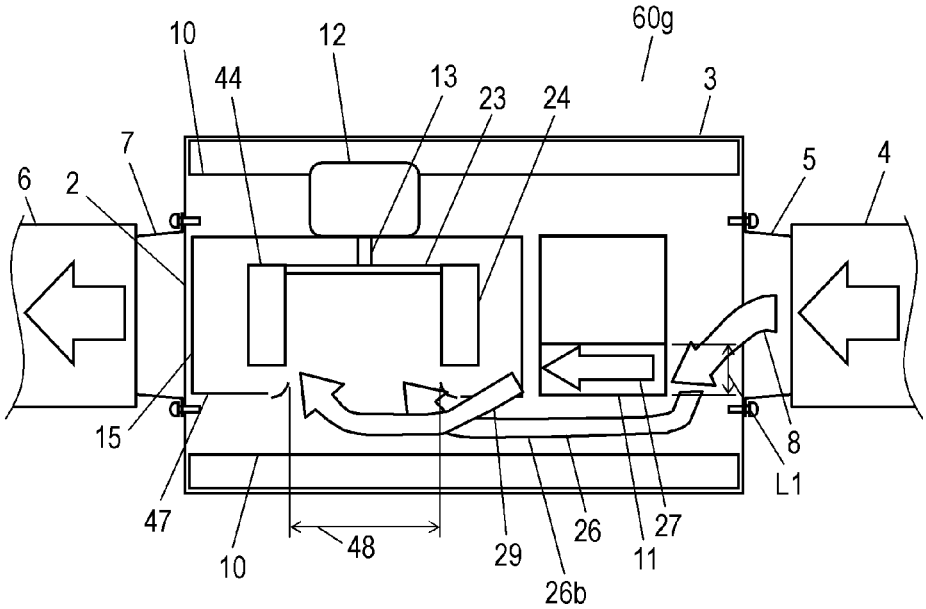
FIG. 15A is a plan view of a fan with a sound deadening box according to a seventh embodiment of the present invention.
Figure 15B:
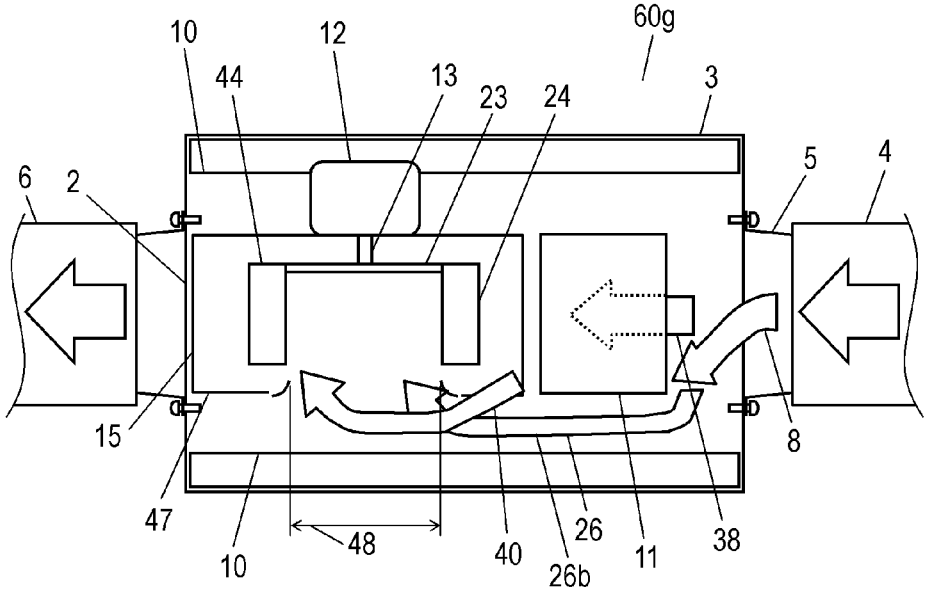
FIG. 15B is a plan view of another example of the fan with the sound deadening box according to the seventh embodiment.

A seventh embodiment of the present invention will be described as follows with reference to drawings. The same components as in the first to sixth embodiments are denoted by the same reference numerals, and thus a detailed description thereof will be omitted. FIG. 15A is a plan view of fan 60*g* with a sound deadening box (hereinafter, fan 60*g*) according to the seventh embodiment. FIG. 15B is a plan view of another example of fan 60*g* with the sound deadening box according to the seventh embodiment.

Fan 60*g* of the seventh embodiment includes single inlet centrifugal fan 47 (hereinafter, fan 47) having single inlet impeller 44 (hereinafter, impeller 44) instead of double inlet centrifugal fan 9 of fan 60 of the first embodiment. In short, fan 60*g* includes fan 47 and air passages 27 as shown in FIG. 15A.

With this structure, fan 60*g* has a large air passage section up to casing inlet port 48, thereby having a low airflow collision loss.

Thus, fan 60*g* of the seventh embodiment has a low pressure loss in air passage 26*b*, while ensuring the air flow. Fan 60*g* also has a low level of airflow collision noise.

Alternatively, fan 60*g* may include air passage 38 instead of air passage 27 as shown in FIG. 15B, thereby having a low pressure loss in air passage 26*b* and a low level of airflow collision noise, while ensuring the air flow in the same manner. Although not illustrated, fan 60*g* may alternatively include both air passages 27 and 38, thereby having a low pressure loss in air passage 26*b*, while ensuring the air flow in the same manner.

Eighth Embodiment

Figure 16:
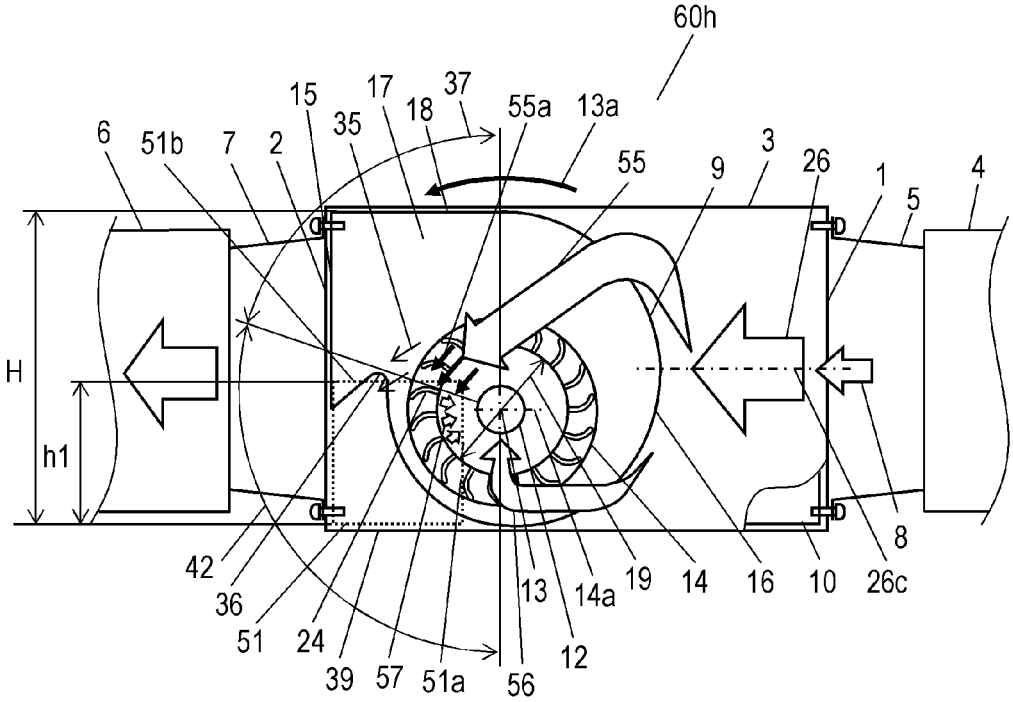
FIG. 16 is a side view of a fan with a sound deadening box according to an eighth embodiment of the present invention.
Figure 17:
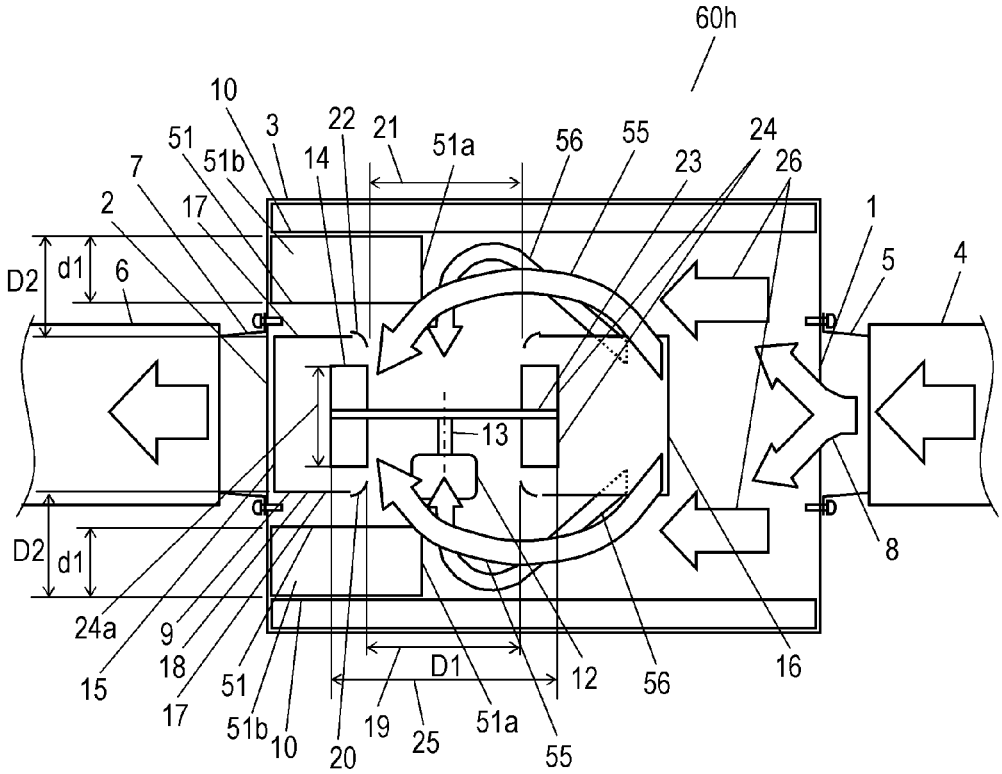
FIG. 17 is a plan view of the fan of FIG. 16.
Figure 18A:
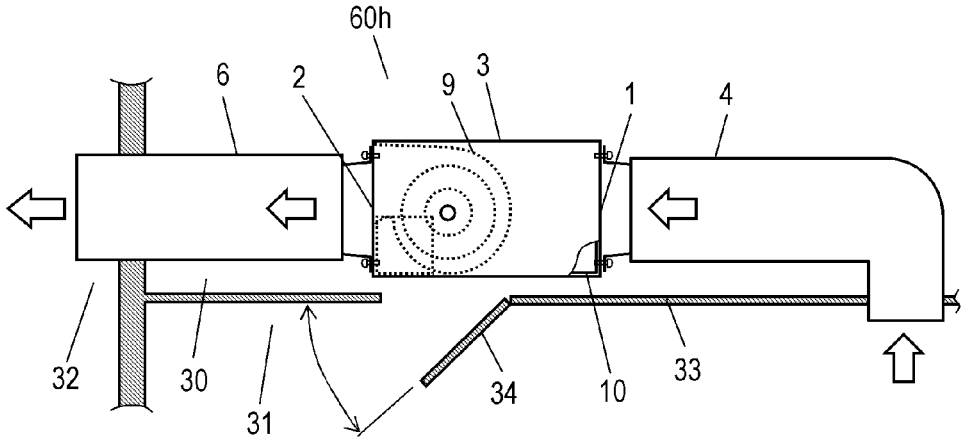
FIG. 18A is a side view where the fan of FIG. 16 is installed.
Figure 18B:
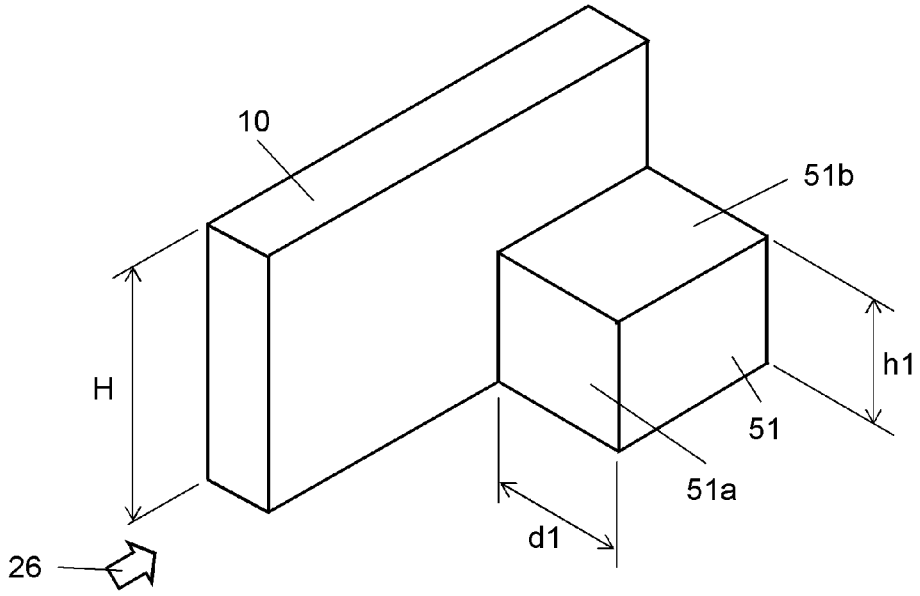
FIG. 18B is a perspective view of another example of a body sound absorber used in the fan of FIG. 16.
Figure 19:
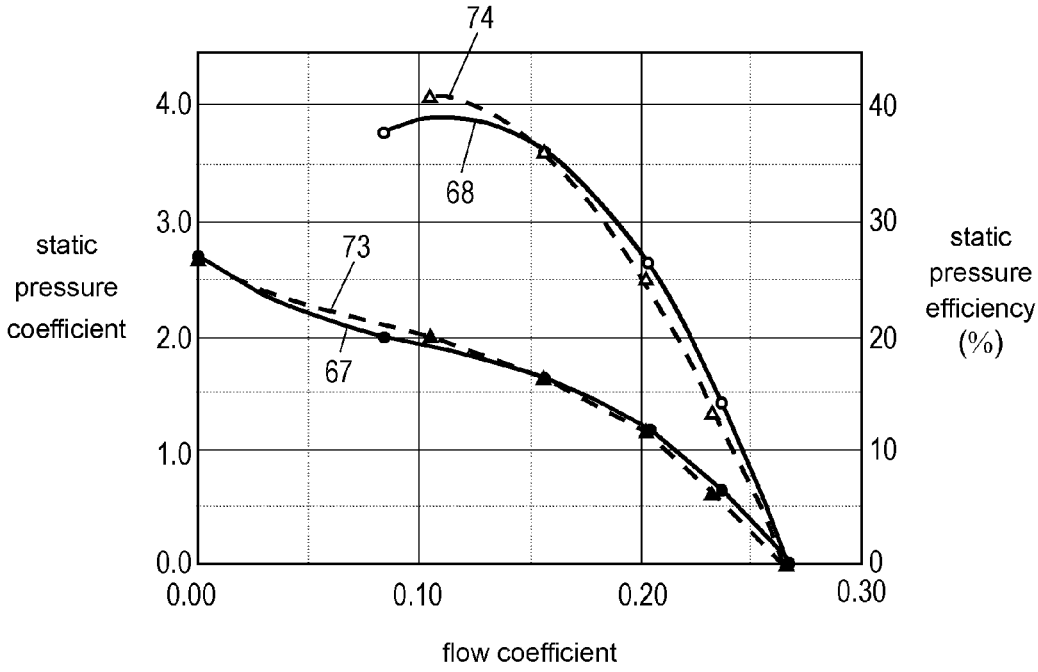
FIG. 19 is a non-dimensional characteristic diagram showing characteristics of the fan of FIG. 16.

An eighth embodiment of the present invention will be described as follows with reference to drawings. The same components as in the first to seventh embodiments are denoted by the same reference numerals, and thus a detailed description thereof will be omitted. FIG. 16 is a side view of fan 60*h* with a sound deadening box (hereinafter, fan 60*h*) according to the eighth embodiment. FIG. 17 is a plan view of fan 60*h* of FIG. 16. FIG. 18A is a side view where fan 60*h* of FIG. 16 is installed. FIG. 18B is a perspective view of another example of body sound absorber 10 used in fan 60*h* of FIG. 16. FIG. 19 is a non-dimensional characteristic diagram showing characteristics of fan 60*h* of FIG. 16.

As shown in FIGS. 16 and 17, fan 60*h* of the eighth embodiment includes body sound absorbers 10 different from body sound absorbers 10 of fan 60 of the first embodiment, and does not include inlet-port sound absorber 11. Sound absorbers 10 featuring fan 60*h* of the eighth embodiment will be described as follows.

Sound absorbers 10 are disposed on the inner surfaces of body 3 that face ports 19 and 21, and have a height H equal to the height H inside body 3. Air passages 26 have a center height at center height position 26*c*, and impeller 14 has a center height at center height position 14*a*.

Each sound absorber 10 includes rectifying member 51 having a rectangular cross section and a height h1 smaller than the height H of body 3 so as to satisfy a relation of H>h1. Rectifying members 51 narrow air passages 26 toward discharge port 15 of fan 9, that is, toward ports 19 and 21, and also narrow them from the body plane 39 side on the tongue 36 side of fan 9. Rectifying members 51 are disposed to face side plates 17 in parallel therewith in the vicinity of tongue 36.

Each rectifying member 51 is provided at one end face thereof with vertical rectification stage 51*a* (hereinafter, stage 51*a*). Stages 51*a* are located in front of ports 19 and 21, and orthogonal to the airflows passing through air passages 26. Each rectifying member 51 is provided at the other end face thereof with horizontal rectification stage 51*b* (hereinafter, stage 51*b*). Stages 51*b* are located in parallel with the airflows passing through air passages 26, and also in parallel with body plane 39 between body plane 39 and tongue 36. As a result, each of the airflows passed through air passages 26 is vertically divided along the outer periphery of scroll 16 into discharge-port-side airflow 55 (hereinafter, airflow 55) and tongue-side airflow 56 (hereinafter, airflow 56). In the vicinity of fan 9, airflows 55 are discharged through discharge port 15 after becoming directed-to-discharge-port suction airflow 55*a* (hereinafter, airflow 55*a*), which is inclined toward the suction center of impeller 14. Rectifying members 51 narrow air passages 26 to an extent corresponding to the thickness d1 of stages 51*a* toward discharge port 15. Rectifying members 51 narrow air passages 26 to an extent corresponding to the height h1 of rectifying members 51 from the body plane 39 side, also.

Rectifying members 51 can be made of the same sound absorbing material as used for sound absorber 11. The thickness d1 of stages 51*a* and the width D2 of air passages 26 satisfy a relation of d1>0.5×D2. As a result, the thickness d1 of stages 51*a* is set properly with respect to the width D2 of air passages 26. This increases the volume of the sound absorbing material to an extent corresponding to an increase in the amount of the sound absorbing material, thereby increasing the effect of sound absorbers 10.

Alternatively, sound absorbers 10 may be integrated with rectifying members 51 as shown in FIG. 18B. This can reduce the number of components of fan 60*h*, thereby reducing cost and improving the production efficiency. Furthermore, air passages 26 can be narrowed with high positioning precision, thereby providing the action and effect of rectifying members 51 in a stable manner.

With this structure, the airflows passed through air passages 26 are deflected along stages 51*a* and 51*b* and supplied to ports 19 and 21. This blocks the pre-swirling flow in the vicinity of ports 19 and 21 in rotational direction 13*a* of impeller 14, thereby having a low occurrence of turbulent flow in the vicinity of ports 19 and 21.

Centrifugal fans generally tend to cause backflow 57 in region 42, and hence, to have low air flow in ports 19 and 21. Fan 60*h* of the present invention, however, includes rectifying members 51 in region 42 so as to reduce backflow 57. Furthermore, air passages 26 in front of rectifying members 51, right in front of rectifying members 51, are prevented from a pressure loss increase which tends to be due to a narrow passage. Airflow 55*a* joins discharge airflow 35 in such a manner as to be substantially in parallel therewith, thereby having a low blowing load of airflow. More specifically, centrifugal fans generally have a low blowing efficiency in region 37; however, airflow 55*a* smoothly pass through between blades 24 and becomes airflow 35, thereby having a blowing load. In addition, since scroll 16 is logarithmic-spirally increased, the lower center height position 14*a* of impeller 14 is than center height position 26*c* of air passages 26, the larger airflows 55 is than airflows 56. This amplifies the aforementioned action and effect.

The thickness d1 of stages 51*a* of rectifying members 51 made of the sound absorbing material is set properly with respect to the width D2 of air passages 26. This increases the volume of the sound absorbing material to an extent corresponding to an increase in the amount of the sound absorbing material, thereby increasing the effect of sound absorbers 10.

Thus, fan 60*h* of the eighth embodiment has a low pressure loss due to a low turbulent flow in the vicinity of ports 19 and 21, and a low occurrence of backflow 57, and hence a low pressure loss increase in air passages 26 right in front of rectifying members 51. As a result, fan 60*h* has high air flow, a low input, and a low level of turbulent flow noise.

As long as rectifying members 51 include stages 51*a* and 51*b* facing air passages 26, their ridge lines may be R-shaped curved so as to provide the aforementioned action and effect.

It is possible to reduce impeller 14 in size according to the reduction in the pressure loss in air passages 26, thereby reducing fan 9 in size and body 3 in thickness. As a result, attic 30 can have a small vertical space, securing a high-ceilinged space indoors 31. In addition, fan 60*h* can be easily removed for maintenance through small ceiling access door 34. Thus, fan 60*h* requires little maintenance strain.

FIG. 19 is a characteristic diagram comparing operating characteristics between a conventional fan with a sound deadening box in which the air guide plate is inclined with respect to the casing inlet port, and fan 60*h* of the present invention. In the diagram, solid line 67 represents a relation between flow coefficient and static pressure coefficient of fan 60*h* according to the eighth embodiment, and solid line 68 represents a relation between flow coefficient and static pressure efficiency of fan 60*h*. Similarly, dotted line 73 represents a relation between flow coefficient and static pressure coefficient of the conventional fan, and dotted line 74 represents a relation between flow coefficient and static pressure efficiency of the conventional fan. Fan 60*h* shown in FIG. 19 includes rectifying members 51 having stages 51*a* of a thickness d1 of 65 mm and air passages 26 having a width D2 of 85 mm. Stages 51*b* are extended from tongue 36 so as to face center height 14*a* of impeller 14 below. In both double inlet centrifugal fans shown in FIG. 19, the double inlet impellers have a diameter D1 of 176 mm and a fan casing height of 329 mm, and the motor has four poles and an outer diameter of 120 mm, respectively.

As shown in FIG. 19, fan 60*h* has a higher static pressure efficiency than the conventional fan when the flow coefficient is in the range of 0.16 to 0.27. One reason for this is as follows. As described above, centrifugal fans generally tend to cause backflow 57 in region 42, and hence, to have low air flow in ports 19 and 21. Fan 60*h*, however, has rectifying members 51 in region 42 so as to reduce backflow 57 and to suppress an increase in the pressure loss, which is due to the reduction in width of air passages 26 right in front of rectifying members 51. Another reason seems to be that airflow 55*a* joins airflow 35 in such a manner as to be substantially in parallel therewith, thereby having a low blowing load. The aforementioned action and effect is amplified in regions having a large amount of air flow, probably because the airflow to impeller 14 is effectively controlled.

Fan 60*h* of the eighth embodiment does not have sound absorber 11 used in the first to seventh embodiments, but may alternatively have it, thereby having a low pressure loss in the sound-deadening air passage, a low input, high static pressure, and a low level of airflow collision noise.

Ninth Embodiment

Figure 20:
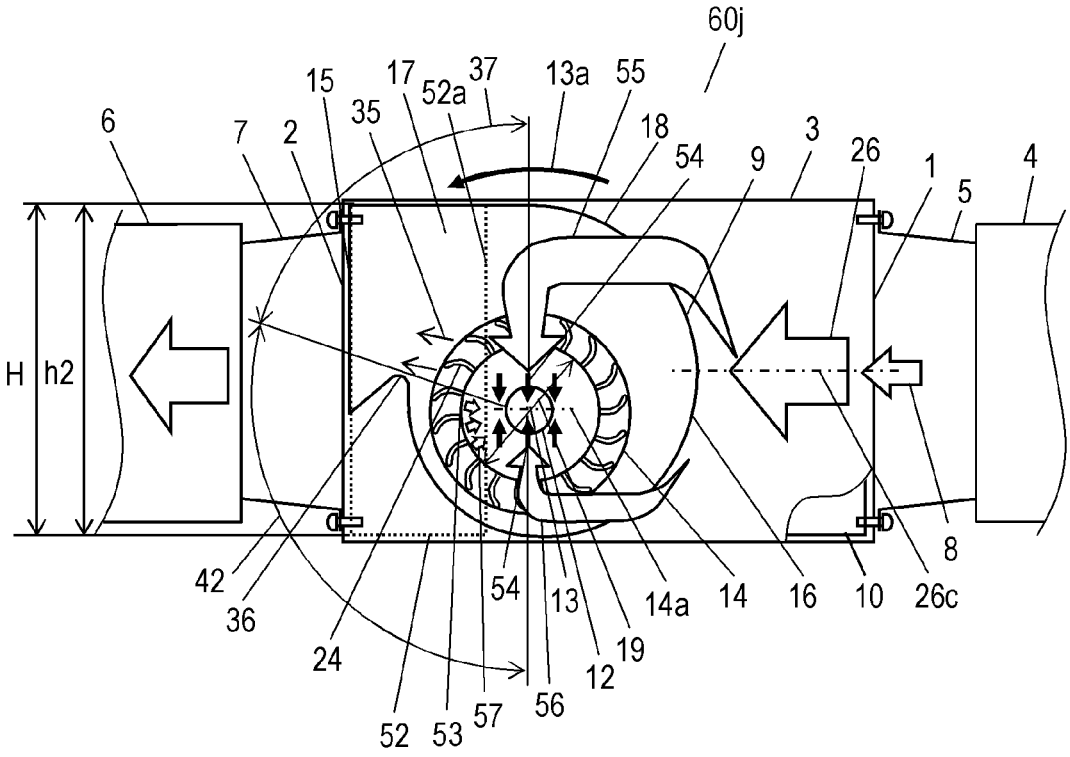
FIG. 20 is a side view of a fan with a sound deadening box according to a ninth embodiment of the present invention.
Figure 21A:
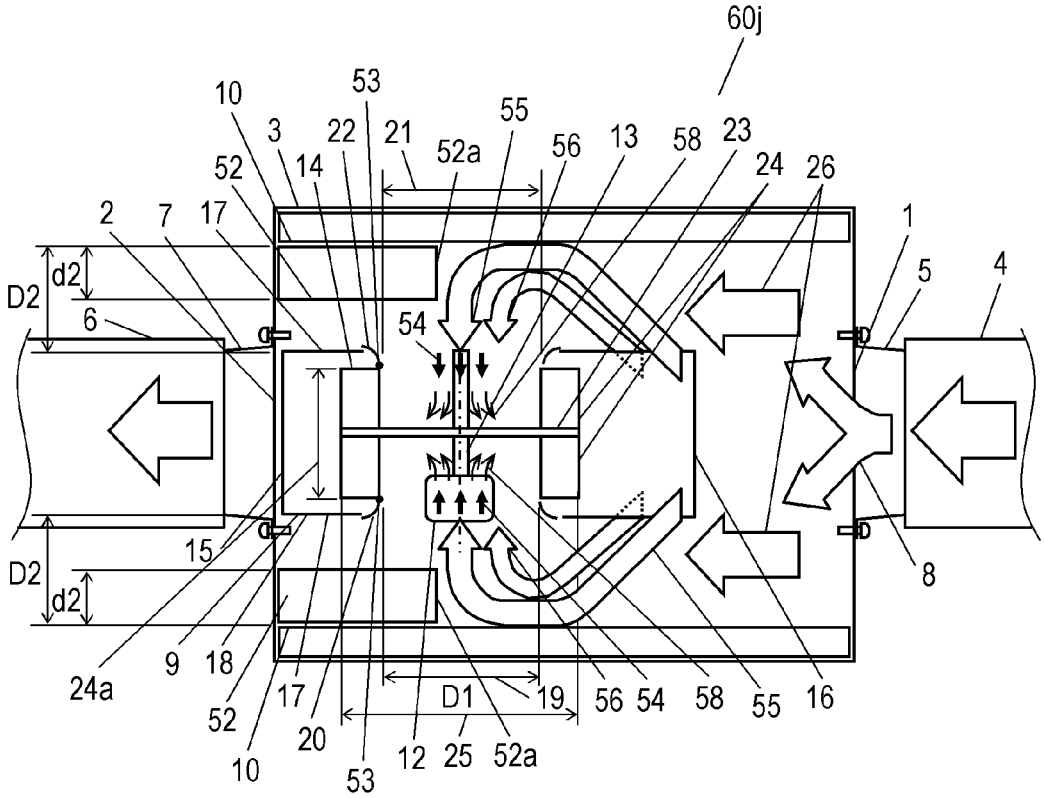
FIG. 21A is a plan view of the fan of FIG. 20.
Figure 21B:
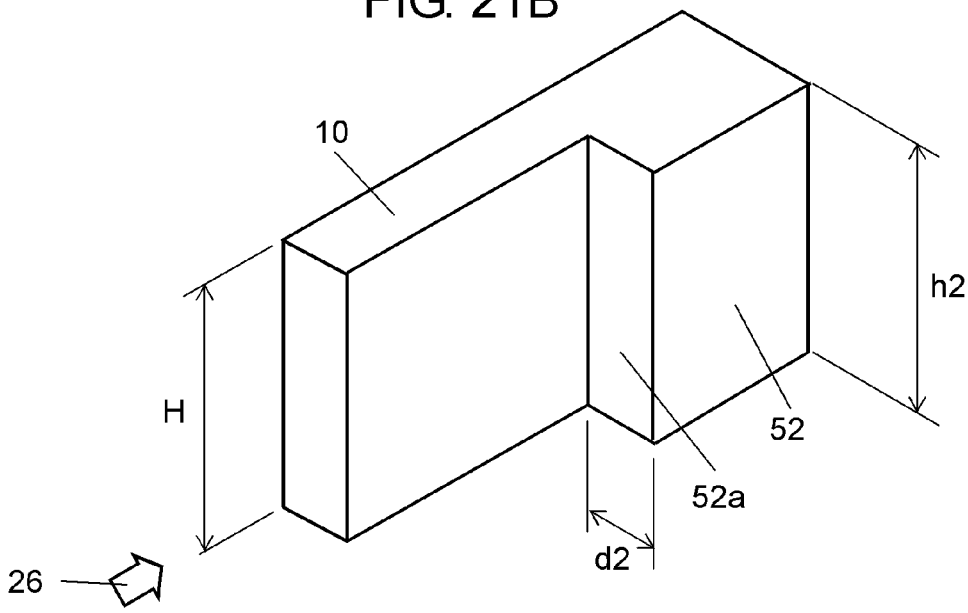
FIG. 21B is a perspective view of another example of a body sound absorber used in the fan of FIG. 20.
Figure 22:
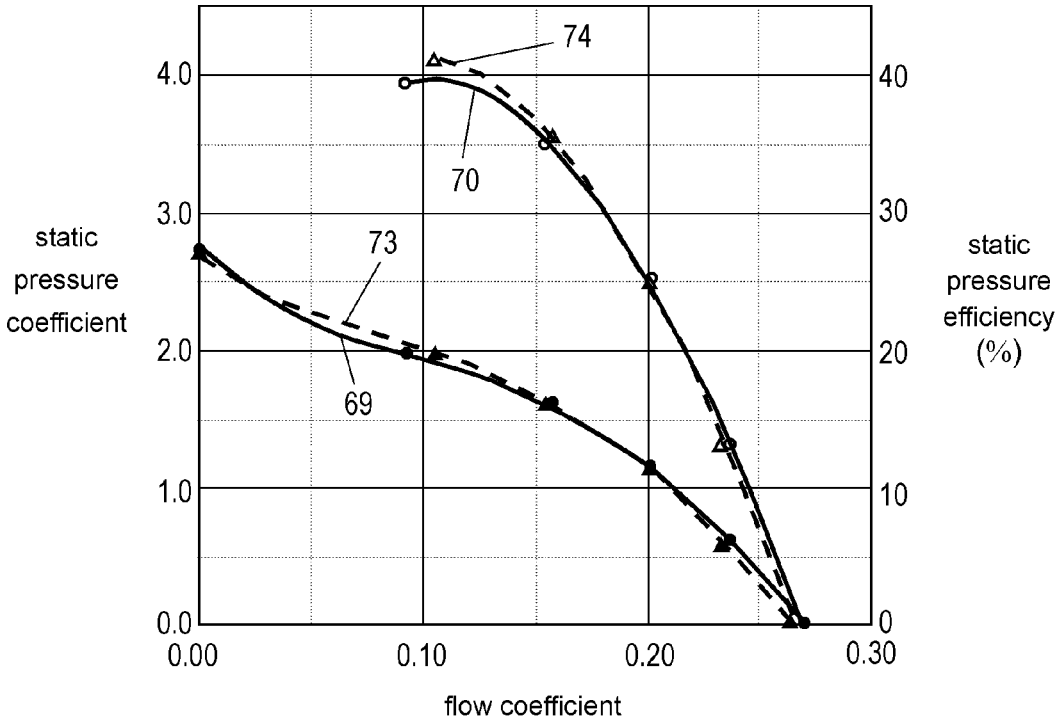
FIG. 22 is a non-dimensional characteristic diagram showing characteristics of the fan of FIG. 20.

A ninth embodiment of the present invention will be described as follows with reference to drawings. The same components as in the first to eighth embodiments are denoted by the same reference numerals, and thus a detailed description thereof will be omitted. FIG. 20 is a side view of fan 60*j* with a sound deadening box (hereinafter, fan 60*j*) according to the ninth embodiment. FIG. 21A is a plan view of fan 60*j* of FIG. 20. FIG. 21B is a perspective view of another example of body sound absorber 10 used in fan 60*j* of FIG. 20. FIG. 22 is a non-dimensional characteristic diagram showing characteristics of fan 60*j* of FIG. 20.

As shown in FIGS. 20 and 21, fan 60*j* of the ninth embodiment includes guide members 52 instead of rectifying members 51 of fan 60*h* of the eighth embodiment. In short, each sound absorber 10 includes guide member 52 having a rectangular cross section. Guide members 52 have a height h2 substantially equal to the height H of body 3 so as to satisfy a relation of H≈h2. Guide members 52, which are disposed to face side plates 17 in parallel therewith, narrow air passages 26 toward discharge port 15 of fan 9, that is, toward ports 19 and 21.

Each guide member 52 is provided on an end face thereof with vertical guide stage 52*a* (hereinafter, stage 52*a*). Stages 52*a* are located in front of ports 19 and 21, and orthogonal to the airflows passing though air passages 26. Stages 52*a* are located between discharge-port-side ends 53 of ports 19, 21 and drive shaft 13. As a result, each of the airflows passed through air passages 26 is vertically divided along the outer periphery of scroll 16 into airflows 55 and 56. In the vicinity of fan 9, airflow 55 and airflow 56 pass through ports 19 and 21 after becoming directed-to-axis-of-rotation airflows 54 (hereinafter, airflows 54) flowing toward drive shaft 13. Guide members 52 narrow air passages 26 to an extent corresponding to a thickness d2 of stages 52*a* toward discharge port 15.

Guide members 52 can be made of the same sound absorbing material as used for sound absorber 11. The thickness d2 of stages 52*a* and the width D2 of air passages 26 satisfy a relation of d2>0.3×D2. As a result, the thickness d2 of stages 52*a* is set properly with respect to the width D2 of air passages 26. This increases the volume of the sound absorbing material to an extent corresponding to an increase in the amount of the sound absorbing material, thereby increasing the effect of sound absorbers 10.

Alternatively, sound absorbers 10 may be integrated with guide members 52 as shown in FIG. 21B. This can reduce the number of components of fan 60*j*, thereby reducing the cost and improving the production efficiency. Furthermore, air passages 26 can be narrowed with high positioning precision, thereby providing the action and effect of guide members 52 in a stable manner.

With this structure, the airflows passed through air passages 26 are deflected along stages 52*a* and supplied to ports 19 and 21. This blocks the pre-swirling flow in the vicinity of ports 19 and 21 in rotational direction 13*a* of impeller 14, thereby having a low occurrence of turbulent flow in the vicinity of ports 19 and 21.

Fan 60*j* includes guide members 52 in regions 37 and 42, so that air passages 26 right in front of guide members 52 are prevented from having a pressure loss increase which tends to be due to a narrow passage. Airflows 54 join suction airflows 58 (hereinafter, airflows 58) flowing toward drive shaft 13 of impeller 14 in such a manner as to be substantially in parallel therewith, thereby having a low blowing load of airflow. More specifically, centrifugal fans generally tend to cause backflow 57 and low air flow in ports 19 and 21 in region 42, and also a low blowing efficiency in region 37. However, in fan 60*j*, airflows 54 smoothly pass through ports 19, 21 and become airflows 58, thereby having a low blowing load.

The thickness d2 of stages 52*a* of guide members 52 made of the sound absorbing material is set properly with respect to the width D2 of air passages 26. This increases the volume of the sound absorbing material to an extent corresponding to an increase in the amount of the sound absorbing material, thereby increasing the effect of sound absorbers 10.

Thus, fan 60*j* of the ninth embodiment has a low pressure loss due to a low turbulent flow in the vicinity of ports 19 and 21, and a low pressure loss increase in air passages 26 right in front of guide members 52. As a result, fan 60*j* has high air flow, a low input, and a low level of turbulent flow noise.

As long as guide members 52 include stages 52*a* facing air passages 26, their ridge lines may be R-shaped curved so as to provide the aforementioned action and effect.

It is possible to reduce impeller 14 in size according to the reduction in the pressure loss in air passages 26, thereby reducing fan 9 in size and body 3 in thickness. As a result, attic 30 can have a small vertical space, securing a high-ceiling space indoors 31. In addition, fan 60*j* can be easily removed for maintenance through small ceiling access door 34. Thus, fan 60*j* requires little maintenance strain.

FIG. 22 is a characteristic diagram comparing operating characteristics between the conventional fan with the sound deadening box in which the air guide plate is inclined with respect to the casing inlet port, and fan 60*j* of the present invention. In the diagram, solid line 69 represents a relation between flow coefficient and static pressure coefficient of fan 60*j* according to the ninth embodiment, and solid line 70 represents a relation between flow coefficient and static pressure efficiency of fan 60*j*. Similarly, dotted line 73 represents the relation between flow coefficient and static pressure coefficient of the conventional fan, and dotted line 74 represents the relation between flow coefficient and static pressure efficiency of the conventional fan. Fan 60*j* shown in FIG. 22 includes guide members 52 having stages 52*a* of a thickness d2 of 35 mm and air passages 26 having a width D2 of 85 mm. Stages 52*a* are disposed to face drive shaft 13 of impeller 14. In both double inlet centrifugal fans shown in FIG. 22, the double inlet impellers have a diameter D1 of 176 mm and a fan casing height of 329 mm, and the motor has four poles and an outer diameter of 120 mm, respectively.

As shown in FIG. 22, fan 60*j* has a higher static pressure efficiency than the conventional fan when the flow coefficient is in the range of 0.20 to 0.27. One reason for this is as follows. As described above, fan 60*j* includes guide members 52 in regions 37 and 42, so that air passages 26 right in front of guide members 52 are prevented from having a pressure loss increase which tends to be due to a narrow passage. Another reason seems to be that airflows 54 join airflows 58 flowing toward drive shaft 13 in such a manner as to be substantially in parallel therewith, thereby having a low blowing load. The aforementioned action and effect is amplified in regions having a large amount of air flow, probably because the airflow to impeller 14 is effectively controlled.

Fan 60*j* of the ninth embodiment does not have sound absorber 11 used in the first to seventh embodiments, but may alternatively have it, thereby having a low pressure loss in the sound-deadening air passage, a low input, high static pressure, and a low level of airflow collision noise.

Tenth Embodiment

Figure 23:
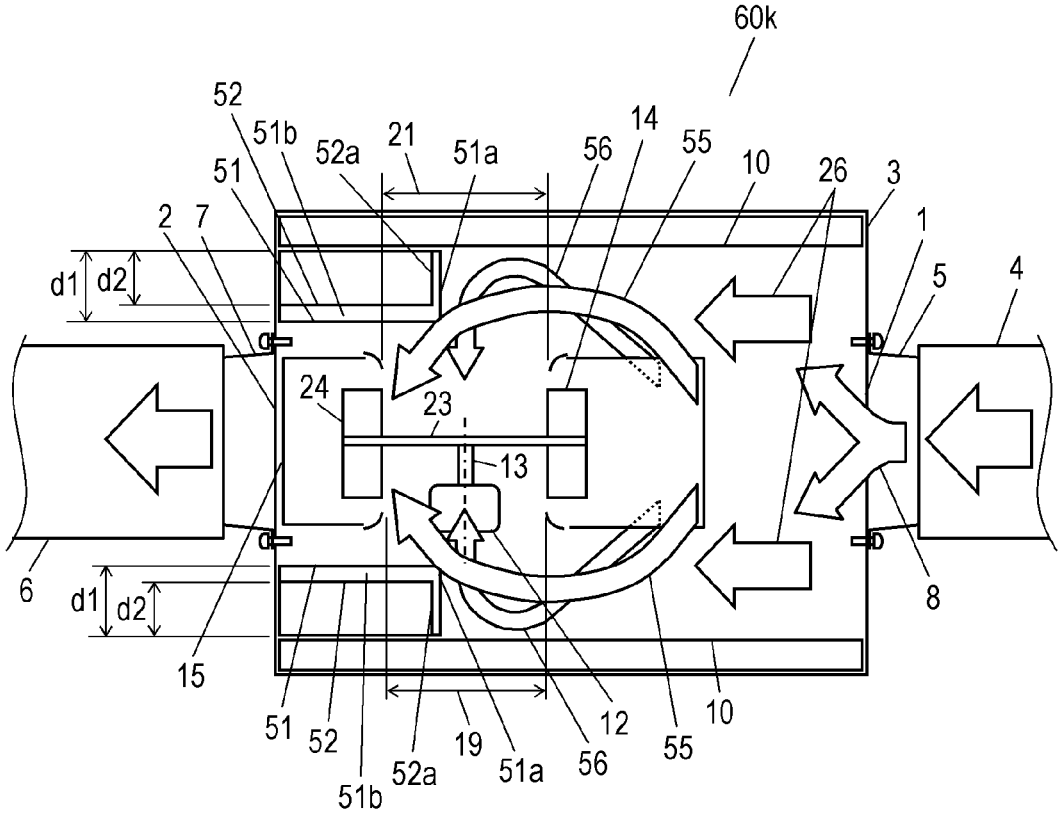
FIG. 23 is a plan view of a fan with a sound deadening box according to a tenth embodiment of the present invention.
Figure 24A:
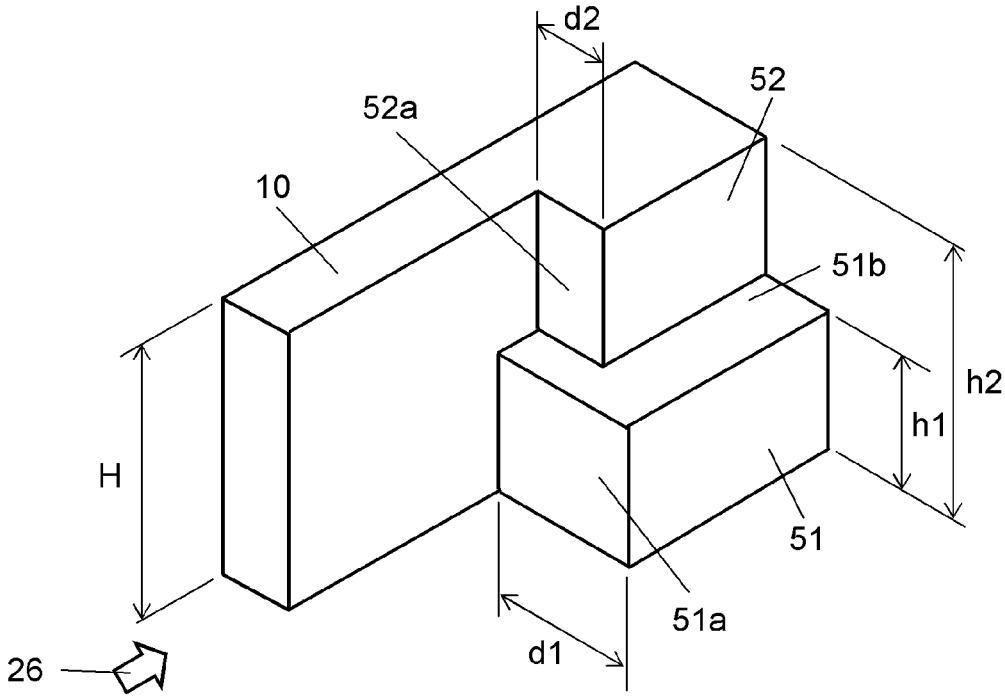
FIG. 24A is a perspective view of another example of a body sound absorber used in the fan of FIG. 23.
Figure 24B:
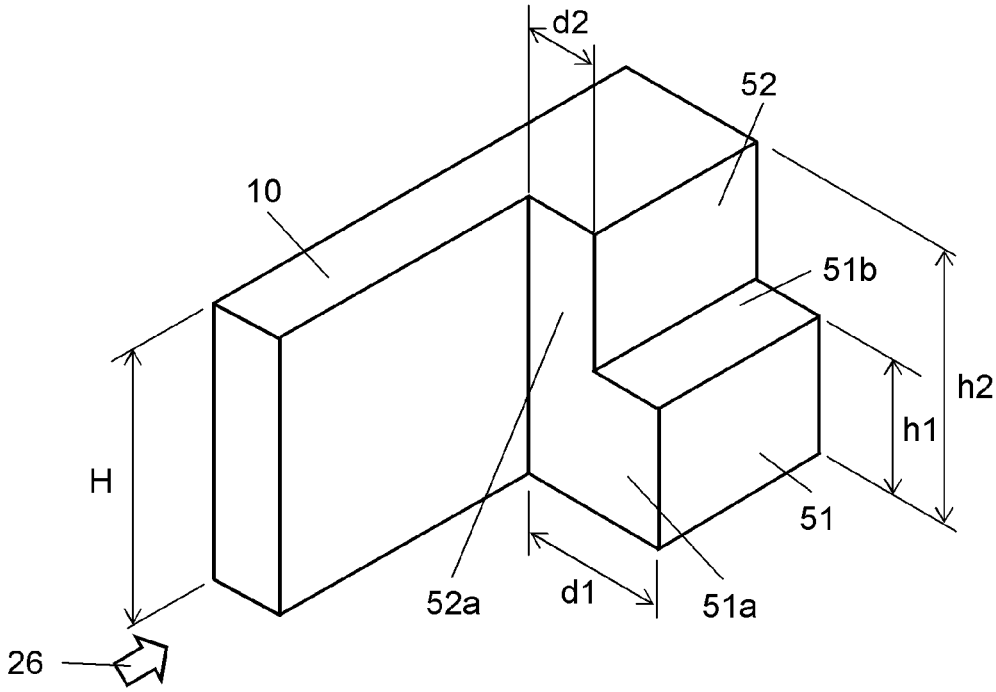
FIG. 24B is a perspective view of further another example of the body sound absorber used in the fan of FIG. 23.

A tenth embodiment of the present invention will be described as follows with reference to drawings. The same components as in the first to ninth embodiments are denoted by the same reference numerals, and thus a detailed description thereof will be omitted. FIG. 23 is a plan view of fan 60*k* with a sound deadening box (hereinafter, fan 60*k*) according to the tenth embodiment. FIG. 24A is a perspective view of another example of body sound absorber 10 used in fan 60*k* of FIG. 23. FIG. 24B is a perspective view of further another example of body sound absorber 10 used in fan 60*k* of FIG. 23.

Fan 60*k* of the tenth embodiment includes guide members 52 used in the ninth embodiment in addition to the components of fan 60*h* of the eighth embodiment. More specifically, as shown in FIG. 23, sound absorbers 10 include rectifying members 51 and guide members 52. Stages 51*a* have a thickness d1 larger than the thickness d2 of stages 52*a* so as to satisfy a relation of d1>d2.

With this structure, the airflows passed through air passages 26 are deflected along stages 51*a* and 51*b* and also along stages 52*a* and are supplied to ports 19 and 21. This blocks the pre-swirling flow in the vicinity of ports 19 and 21 in rotational direction 13*a* of impeller 14, thereby having a low occurrence of turbulent flow in the vicinity of ports 19 and 21.

Thus, fan 60*k* of the tenth embodiment includes characteristics of fan 60*h* of the eighth embodiment and characteristics of fan 60*j* of the ninth embodiment, thereby having a lower occurrence of turbulent flow in the vicinity of ports 19, 21 and a lower pressure loss due to a lower turbulent flow. As a result, fan 60*k* has a higher air flow, a lower input, a lower level of turbulent flow noise.

Alternatively, sound absorbers 10 may be integrated with rectifying members 51 and guide members 52 as shown in FIGS. 24A and 24B. More specifically, sound absorbers 10 may have a cross section which is, in part, thick enough to make rectifying members 51 and guide members 52 integrated with sound absorbers 10. Their integration reduces the number of components of fan 60*j* so as to simplify its structure, thereby reducing the cost and improving the production efficiency. Furthermore, air passages 26 can be narrowed with high positioning precision, thereby providing the action and effect of guide members 52 in a stable manner. It is also possible to integrate sound absorbers 10 with either rectifying members 51 or guide members 52 according to the required air flow and the dimension of body 3 so as to provide the similar action and effect.

Fan 60*k* of the tenth embodiment does not have sound absorber 11 used in the first to seventh embodiments, but may alternatively have it, thereby having a low pressure loss in the sound-deadening air passage, a low input, high static pressure, and a low level of airflow collision noise.

Eleventh Embodiment

Figure 25A:
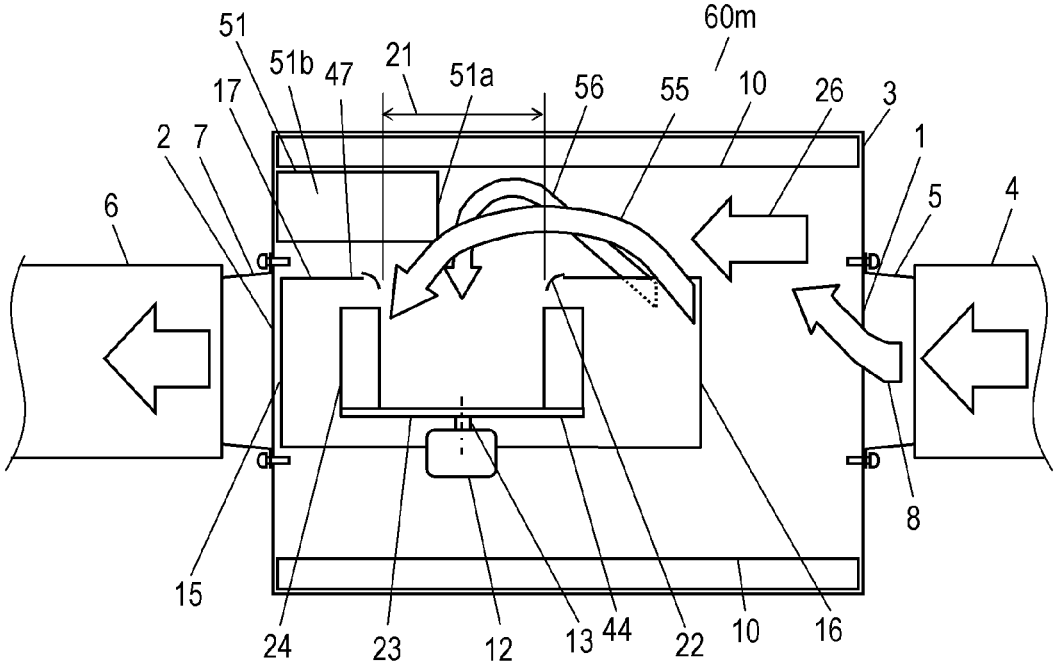
FIG. 25A is a plan view of a fan with a sound deadening box according to an eleventh embodiment of the present invention.
Figure 25B:
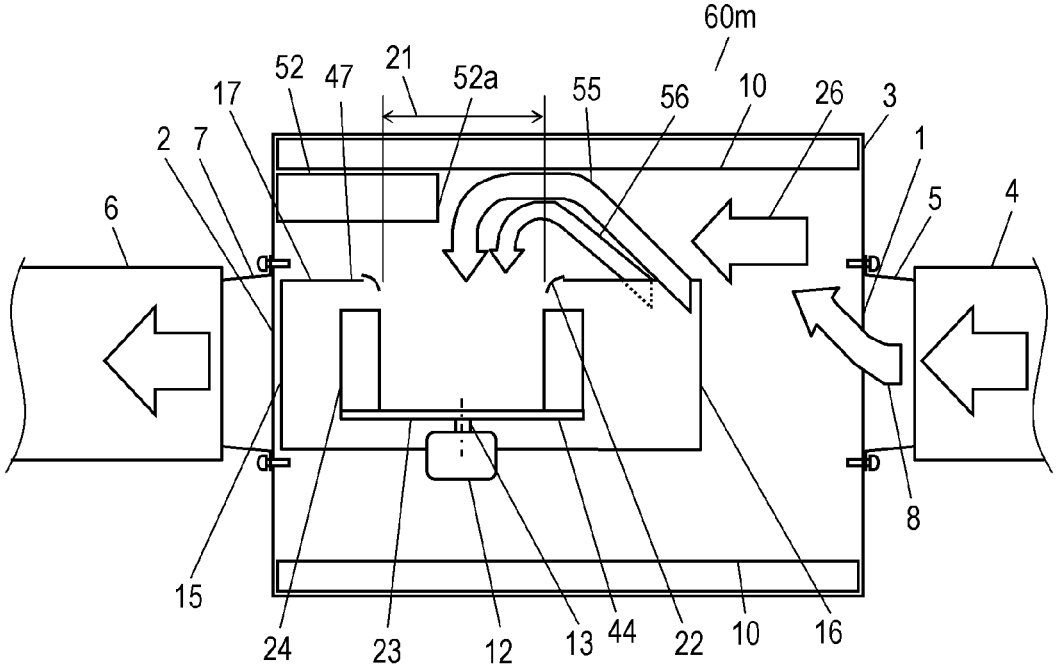
FIG. 25B is a plan view of another example of the fan with the sound deadening box according to the eleventh embodiment.
Figure 26:
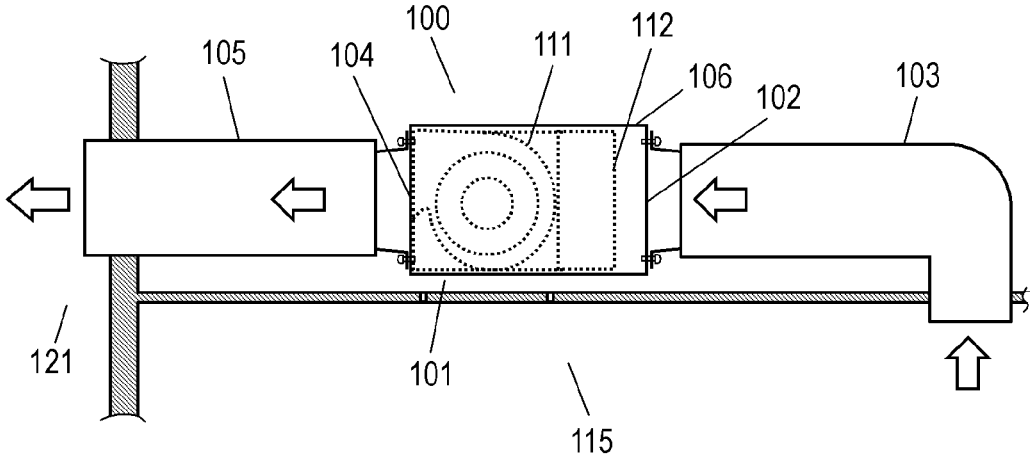
FIG. 26 is a side view where a conventional fan with a sound deadening box is installed.
Figure 27:
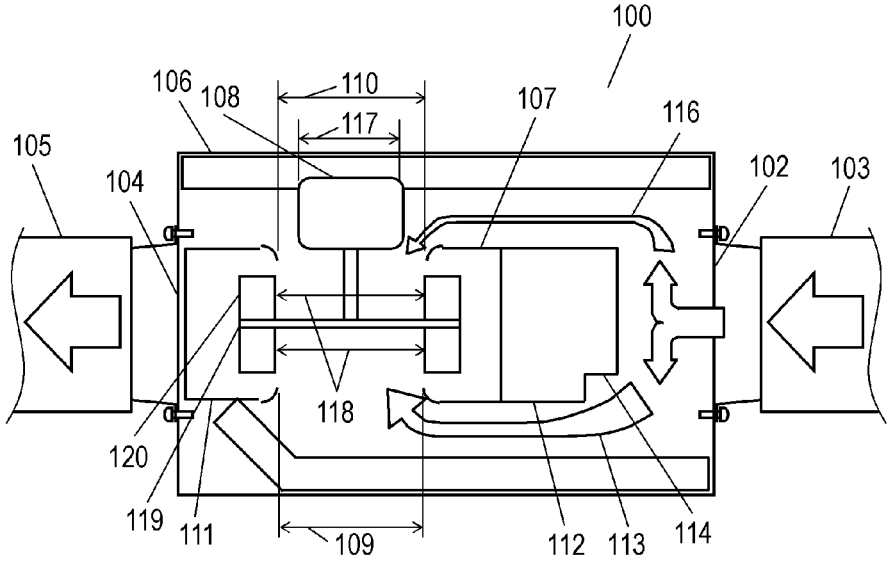
FIG. 27 is a plan view of the conventional fan of FIG. 26.
Figure 28:
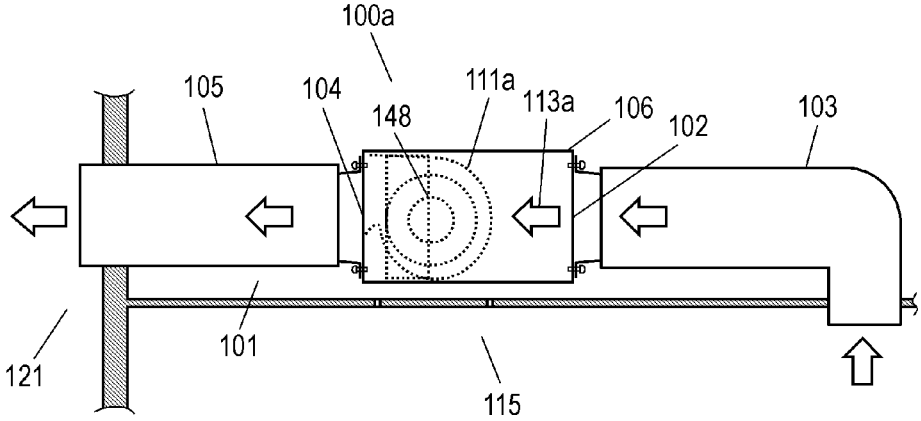
Prior Art FIG. 28
FIG. 28 is a side view where another conventional fan with a sound deadening box is installed.
Figure 29:
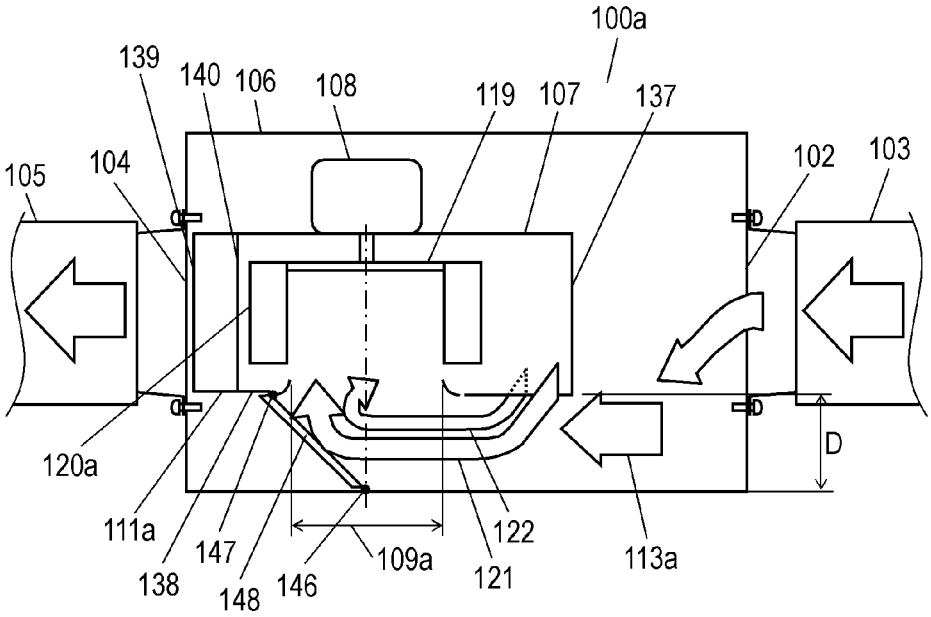
FIG. 29 is a plan view of the conventional fan of FIG. 28.
Figure 30:
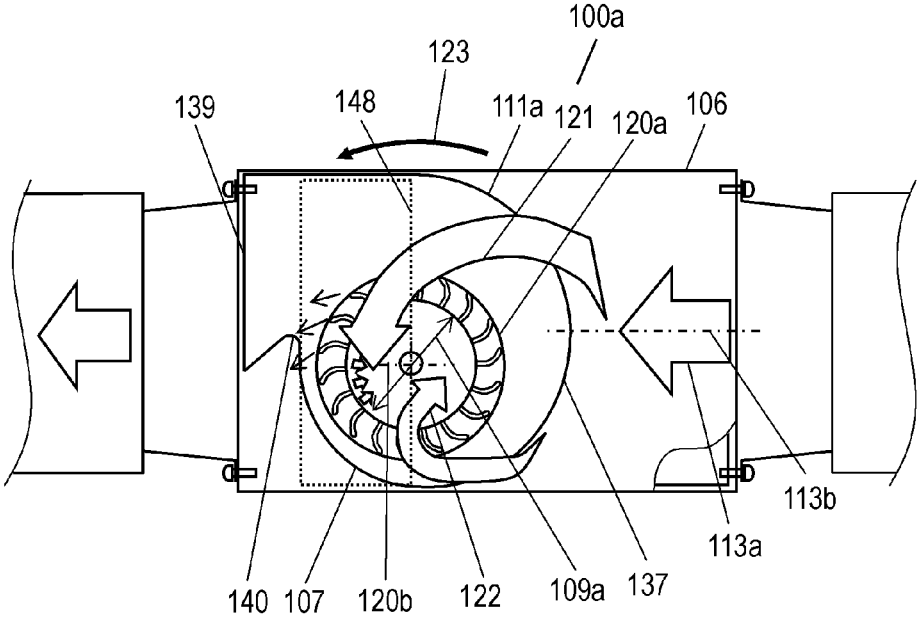
Prior Art FIG. 30
FIG. 30 is a side view of the conventional fan of FIG. 28.

An eleventh embodiment of the present invention will be described as follows with reference to drawings. The same components as in the first to tenth embodiments are denoted by the same reference numerals, and thus a detailed description thereof will be omitted. FIG. 25A is a plan view of fan 60*m* with a sound deadening box (hereinafter, fan 60*m*) according to the eleventh embodiment. FIG. 25B is a plan view of another example of fan 60*m* with a sound deadening box according to the eleventh embodiment.

Fan 60*m* of the eleventh embodiment includes fan 47 instead of fan 9 used in fan 60*h* of the eighth embodiment. In short, fan 60*m* includes fan 47 and rectifying member 51 as shown in FIG. 25A.

With this structure, the airflow passed through air passage 26 is deflected along stages 51*a*, 51*b* and supplied to port 21. This blocks the pre-swirling flow in the vicinity of port 21 in rotational direction 13*a* of impeller 44, thereby having a low occurrence of turbulent flow in the vicinity of port 21.

Thus, fan 60*m* of the eleventh embodiment has a low pressure loss due to a low turbulent flow in the vicinity of port 21, and a pressure loss increase in air passage 26 right in front of rectifying member 51. As a result, fan 60*m* has high air flow, a low input, and a low level of turbulent flow noise.

Alternatively, fan 60*m* may include guide member 52 instead of rectifying member 51 as shown in FIG. 25B. In this case, too, fan 60*m* has a low pressure loss due to a low turbulent flow in the vicinity of port 21, and a low pressure loss increase in air passage 26 right in front of guide member 52. As a result, fan 60*m* has high air flow, a low input, and a low level of turbulent flow noise. Although not illustrated, fan 60*m* may alternatively include fan 47, rectifying member 51, and guide member 52, thereby having a pressure loss due to a low turbulent flow in the vicinity of port 21.

INDUSTRIAL APPLICABILITY

The fan of the present invention can be applied for air transfer not only in ventilation fans, air conditioners, dehumidifiers, humidifiers, and air cleaners, but also in other devices in order to cool the devices, reduce the pressure loss, ensure the air flow, increase the cooling effect, or reduce the installation size by supplying air through the body air outlet.

The invention claimed is:

1. A fan with a sound deadening box, the fan comprising:
- a box-shaped body having a body air inlet and a body air outlet facing each other;
- a double inlet centrifugal fan disposed in the body, the double inlet centrifugal fan including:
  - a discharge port;
  - a spiral scroll;
  - casing inlet ports;
  - a fan casing having casing side plates on both sides thereof, the casing side plates having the casing inlet ports;
  - a motor disposed on a side of one of the casing inlet ports; and
  - a double inlet impeller driven by the motor;
- an inlet-port sound absorber disposed between the body air inlet and the double inlet centrifugal fan;
- casing-inlet-port-side air passages formed in spaces between the body air inlet and the casing inlet ports, the spaces being sandwiched between the double inlet centrifugal fan and inner surfaces of the body that face the casing inlet ports; and
- a first inlet-port-sound-absorber air passage formed to have a triangular prism shape by cutting a corner of a ridge line of the inlet-port sound absorber.

2. The fan with the sound deadening box of claim 1, wherein the first inlet-port-sound-absorber air passage is formed on an inner surface side of the body on the discharge port side.

3. The fan with the sound deadening box of claim 1, wherein
- an airflow passed through the first inlet-port-sound-absorber air passage forms a directed-to-discharge-port airflow, the directed-to-discharge-port airflow being discharged through the discharge port at an angle inclined toward a suction center of the double inlet impeller in a vicinity of the double inlet centrifugal fan.

4. The fan with a sound deadening box of claim 1, wherein
- the corner of the ridge line of the inlet-port sound absorber is cut in such a manner as to have a cut dimension L1, and the double inlet impeller has a diameter D1 so as to satisfy a relation of L1<D1.

5. The fan with the sound deadening box of claim 1, further comprising:
- a scroll rear-side air passage formed in a space between the inlet-port sound absorber and the scroll.

6. The fan with the sound deadening box of claim 5, wherein the space forming the scroll rear-side air passage provides a dimension L3 between the inlet-port sound absorber and the scroll, and the double inlet impeller has a diameter D1 so as to satisfy a relation of L3<D1.

7. A fan with the sound deadening box, the fan comprising:
- a box-shaped body having a body air inlet and a body air outlet facing each other;
- a single inlet centrifugal fan disposed in the body, the single inlet centrifugal fan including:
  - a discharge port;
  - a spiral scroll;
  - a casing inlet port;
  - a fan casing having a casing side plate on a side thereof, the casing side plate having the casing inlet port;
  - a motor; and
  - a single inlet impeller driven by the motor;
- an inlet-port sound absorber disposed between the body air inlet and the single inlet centrifugal fan;
- casing-inlet-port-side air passage formed in space between the body air inlet and the casing inlet port, the space being sandwiched between the single inlet centrifugal fan and inner surface of the body that face the casing inlet port; and
- a first inlet-port-sound-absorber air passage formed to have a triangular prism shape by cutting a corner of a ridge line of the inlet-port sound absorber.

8. A fan with a sound deadening box, the fan comprising:

a box-shaped body having a body air inlet and a body air outlet facing each other;

a double inlet centrifugal fan disposed in the body, the double inlet centrifugal fan including:

a discharge port;

a spiral scroll;

casing inlet ports;

a fan casing having casing side plates on both sides thereof, the casing side plates having the casing inlet ports;

a motor disposed on a side of one of the casing inlet ports; and a double inlet impeller driven by the motor;

an inlet-port sound absorber disposed between the body air inlet and the double inlet centrifugal fan;

casing-inlet-port-side air passages formed in spaces between the body air inlet and the casing inlet ports, the spaces being sandwiched between the double inlet centrifugal fan and inner surfaces of the body that face the casing inlet ports; and a second inlet-port-sound-absorber air passage formed to have a rectangular prism shape in a space between a surface of the inlet-port sound absorber that does not face the casing-inlet-port-side air passages and an inner surface of the body that faces the inlet-port sound absorber.

9. The fan with the sound deadening box of claim 8, wherein the second inlet-port-sound-absorber air passage is formed on an inner surface side of the body that faces a body plane on a tongue side of the double inlet centrifugal fan.

10. The fan with the sound deadening box of claim 8, wherein an airflow passed through the second inlet-port-sound-absorber air passage forms a directed-to-tongue airflow, the directed-to-tongue airflow being discharged through the discharge port at an angle inclined toward a suction center of the double inlet impeller in a vicinity of the double inlet centrifugal fan.

11. The fan with the sound deadening box of claim 8, further comprising:

a first inlet-port-sound-absorber air passage formed to have a triangular prism shape by cutting a corner of a ridge line of the inlet-port sound absorber, the first inlet-port-sound-absorber air passage being formed on a side of the inlet-port sound absorber, the side being different from a side having the second inlet-port-sound-absorber air passage.

12. The fan with the sound deadening box of claim 11, wherein the corner of the ridge line of the inlet-port sound absorber is cut in such a manner as to have a cut dimension L1, and the double inlet impeller has a diameter D1 so as to satisfy a relation of L1<D1.

13. The fan with the sound deadening box of claim 8, wherein the space forming the second inlet-port-sound-absorber air passage provides a dimension L2 between the inlet-port sound absorber and the inner surface of the body, and the double inlet impeller has a diameter D1 so as to satisfy a relation of L2<D1.

14. The fan with the sound deadening box of claim 8, further comprising:

a scroll rear-side air passage formed in a space between the inlet-port sound absorber and the scroll.

15. The fan with the sound deadening box of claim 14, wherein the space forming the scroll rear-side air passage provides a dimension L3 between the inlet-port sound absorber and the scroll, and the double inlet impeller has a diameter D1 so as to satisfy a relation of L3<D1.

16. A fan with the sound deadening box, the fan comprising:

a box-shaped body having a body air inlet and a body air outlet facing each other;

a single inlet centrifugal fan disposed in the body, the single inlet centrifugal fan including:

a discharge port;

a spiral scroll;

a casing inlet port;

a fan casing having a casing side plate on a side thereof, the casing side plate having the casing inlet port;

a motor; and a single inlet impeller driven by the motor;

an inlet-port sound absorber disposed between the body air inlet and the single inlet centrifugal fan;

casing-inlet-port-side air passage formed in space between the body air inlet and the casing inlet port, the space being sandwiched between the single inlet centrifugal fan and inner surface of the body that face the casing inlet port; and a second inlet-port-sound-absorber air passage formed to have a rectangular prism shape in a space between a surface of the inlet-port sound absorber that does not face the casing-inlet-port-side air passage and an inner surface of the body that face the inlet-port sound absorber.

17. A fan with a sound deadening box, the fan comprising:

a box-shaped body having a body air inlet and a body air outlet facing each other;

a double inlet centrifugal fan disposed in the body, the double inlet centrifugal fan including:

a discharge port;

a spiral scroll;

casing inlet ports;

a fan casing having casing side plates on both sides thereof, the casing side plates having the casing inlet ports;

a motor disposed on a side of one of the casing inlet ports; and a double inlet impeller driven by the motor;

casing-inlet-port-side air passages formed in spaces between the body air inlet and the casing inlet ports, the spaces being sandwiched between the double inlet centrifugal fan and inner surfaces of the body that face the casing inlet ports;

a body sound absorber between the casing inlet port and the inner surface of the body; and a rectifying member formed at the body sound absorber, the rectifying member having a vertical rectification stage and a horizontal rectification stage, wherein the rectifying member has a height smaller than a height inside the body, and is disposed to face the casing side plate in parallel therewith in the vicinity of the tongue of the casing side plates, thereby narrowing the casing-inlet-port-side air passages both toward the discharge port and from a body plane side on a tongue side of the double inlet centrifugal fan;

the vertical rectification stage is located in front of the casing inlet port, and orthogonal to an airflow passing through the casing-inlet-port-side air passage; and the horizontal rectification stage is located in parallel with the airflow passing through the casing-inlet-port-side air passage.

18. The fan with the sound deadening box of claim 17, wherein the horizontal rectification stage is located in parallel with the body plane between the body plane on the tongue side of the double inlet centrifugal fan and the tongue of the double inlet centrifugal fan; and a discharge-port-side airflow passed through the casing-inlet-port-side air passage forms a directed-to-discharge-port suction airflow, the directed-to-discharge-port suction airflow being discharged through the discharge port at an angle inclined toward a suction center of the double inlet impeller in the vicinity of the double inlet centrifugal fan.

19. The fan with the sound deadening box of claim 17, wherein the rectifying member is made of a sound absorbing material; and the vertical rectification stage has a thickness d1, and the casing-inlet-port-side air passage has a width D2 so as to satisfy a relation of d1>0.5×D2.

20. The fan with the sound deadening box of claim 17, wherein the body sound absorber is integrated with the rectifying member.

21. A fan with a sound deadening box, the fan comprising:

a box-shaped body having a body air inlet and a body air outlet facing each other;

a single inlet centrifugal fan disposed in the body, the single inlet centrifugal fan including:

a discharge port;

a spiral scroll;

a casing inlet port;

a fan casing having a casing side plate on a side thereof, the casing side plate having the casing inlet port;

a motor; and a single inlet impeller driven by the motor;

casing-inlet-port-side air passage formed in spaces between the body air inlet and the casing inlet port, the space being sandwiched between the single inlet centrifugal fan and inner surface of the body that face the casing inlet port;

a body sound absorber between the casing inlet port and the inner surface of the body; and a rectifying member formed at the body sound absorber, the rectifying member having a vertical rectification stage and a horizontal rectification stage, wherein the rectifying member has a height smaller than a height inside the body, and is disposed to face the casing side plate in parallel therewith in the vicinity of the tongue of the casing side plate, thereby narrowing the casing-inlet-port-side air passage both toward the discharge port and from a body plane side on a tongue side of the single inlet centrifugal fan;

the vertical rectification stage is located in front of the casing inlet port, and orthogonal to an airflow passing through the casing-inlet-port-side air passage; and the horizontal rectification stage is located in parallel with the airflow passing through the casing-inlet-port-side air passage.

22. A fan with a sound deadening box, the fan comprising:

a box-shaped body having a body air inlet and a body air outlet facing each other;

a double inlet centrifugal fan disposed in the body, the double inlet centrifugal fan including:

a discharge port;

a spiral scroll;

casing inlet ports;

a fan casing having casing side plates on both sides thereof, the casing side plates having the casing inlet ports;

a motor disposed on a side of one of the casing inlet ports; and a double inlet impeller driven by the motor;

casing-inlet-port-side air passages formed in spaces between the body air inlet and the casing inlet ports, the spaces being sandwiched between the double inlet centrifugal fan and inner surfaces of the body that face the casing inlet ports;

a body sound absorber disposed between the casing inlet port and the inner surface of the body; and a guide member formed on the body sound absorber and having vertical guide stage, wherein the guide member has substantially a same height as a height inside the body and are disposed to face the casing side plate in parallel therewith, thereby narrowing the casing-inlet-port-side air passage toward the discharge port; and the vertical guide stage is located in front of the casing inlet port, and orthogonal to an airflow passing through the casing-inlet-port-side air passage.

23. The fan with the sound deadening box of claim 22, wherein the vertical guide stage is located between discharge-port-side end of the casing inlet port and a drive shaft of the double inlet impeller so as to face the guide member; and a discharge-port-side airflow and a tongue-side airflow respectively passed through the casing-inlet-port-side air passage form a directed-to-axis-of-rotation airflow flowing toward the drive shaft of the double inlet impeller into the casing inlet ports in the vicinity of the double inlet centrifugal fan.

24. The fan with the sound deadening box of claim 22, wherein the guide member is made of a sound absorbing material; and the vertical guide stage has a thickness d2, and the casing-inlet-port-side air passage has a width D2 so as to satisfy a relation of d2>0.3×D2.

25. The fan with a sound deadening box of claim 22, wherein the body sound absorber is integrated with the guide member.

26. The fan with the sound deadening box of claim 22, further comprising:

a rectifying member formed on the body sound absorber, the rectifying member having a vertical rectification stage and a horizontal rectification stage, wherein the rectifying member has a height smaller than a height inside the body, and is disposed to face the casing side plate in parallel therewith in the vicinity of the casing side plate, thereby narrowing the casing-inlet-port-side air passage both toward the discharge port and from a body plane side on a tongue side of the double inlet centrifugal fan;

the vertical rectification stage is located in front of the casing inlet port, and orthogonal to an airflow passing through the casing-inlet-port-side air passage; and the horizontal rectification stage is located in parallel with the airflow passing through the casing-inlet-port-side air passage; and the horizontal rectification stage has a thickness d1, and the vertical guide stage has a thickness d2 so as to satisfy a relation of d1>d2.

27. The fan with the sound deadening box of claim 26, wherein the body sound absorber is integrated with the rectifying member and the guide member.

28. The fan with the sound deadening box of claim 26, wherein the body sound absorber is integrated with either the rectifying member or the guide member.

29. A fan with a sound deadening box, the fan comprising:

a box-shaped body having a body air inlet and a body air outlet facing each other;

a single inlet centrifugal fan disposed in the body, the single inlet centrifugal fan including:

a discharge port;

a spiral scroll;

a casing inlet port;

a fan casing having a casing side plate on a side thereof, the casing side plate having the casing inlet port;

a motor; and a single inlet impeller driven by the motor;

casing-inlet-port-side air passage formed in spaces between the body air inlet and the casing inlet port, the space being sandwiched between the single inlet centrifugal fan and inner surface of the body that face the casing inlet port;

a body sound absorber disposed between the casing inlet port and the inner surface of the body; and a guide member formed on the body sound absorber and having vertical guide stage, wherein the guide member has substantially a same height as a height inside the body and are disposed to face the casing side plate in parallel therewith, thereby narrowing the casing-inlet-port-side air passage toward the discharge port; and the vertical guide stage is located in front of the casing inlet port, and orthogonal to an airflow passing through the casing-inlet-port-side air passage.

* * * * *